US010612346B2

(12) United States Patent
Ross et al.

(10) Patent No.: US 10,612,346 B2
(45) Date of Patent: Apr. 7, 2020

(54) CONCENTRIC FLOW VALVE

(71) Applicant: SPRING OIL TOOLS LLC, Spring, TX (US)

(72) Inventors: Richard J. Ross, Spring, TX (US); Dewayne McCoy Turner, Tomball, TX (US)

(73) Assignee: SPRING OIL TOOLS LLC, Spring, TX (US)

( * ) Notice: Subject to any disclaimer, the term of this patent is extended or adjusted under 35 U.S.C. 154(b) by 149 days.

(21) Appl. No.: 16/008,875

(22) Filed: Jun. 14, 2018

(65) Prior Publication Data

US 2018/0363420 A1 Dec. 20, 2018

Related U.S. Application Data

(60) Provisional application No. 62/519,445, filed on Jun. 14, 2017, provisional application No. 62/643,427, filed on Mar. 15, 2018.

(51) Int. Cl.

| | |
|---|---|
| ***E21B 34/10*** | (2006.01) |
| ***E21B 34/14*** | (2006.01) |
| *E21B 43/26* | (2006.01) |
| *E21B 43/14* | (2006.01) |
| *E21B 43/04* | (2006.01) |
| *E21B 34/00* | (2006.01) |

(52) U.S. Cl.

CPC ..... *E21B 34/14* (2013.01); *E21B 34/10* (2013.01); *E21B 34/103* (2013.01); *E21B 43/04* (2013.01); *E21B 43/14* (2013.01); *E21B 43/26* (2013.01); *E21B 2034/007* (2013.01)

(58) Field of Classification Search

CPC .. E21B 2034/007; E21B 34/10; E21B 34/103; E21B 34/14; E21B 43/04; E21B 43/14; E21B 43/26

See application file for complete search history.

(56) References Cited

U.S. PATENT DOCUMENTS

| | | | |
|---|---|---|---|
| 3,236,255 | A | 2/1966 | Sizer |
| 3,771,603 | A | 11/1973 | Crowe |
| 3,861,470 | A | 1/1975 | Mott |

(Continued)

OTHER PUBLICATIONS

International Search Report and Written Opinion issued in PCT/US2018/037607, dated Sep. 7, 2018 (7 pages).

*Primary Examiner* — Daniel P Stephenson
(74) *Attorney, Agent, or Firm* — Adolph Locklear

(57) ABSTRACT

A concentric flow valve for a dual zone completion tool includes an upper seal bore sleeve, lower inner sleeve, ported sub, opening sleeve, and piston positioned within an outer sub. The upper seal bore sleeve, ported sub, and outer sub define an upper flow bore, and the lower inner sleeve, ported sub, and outer sub define a lower flow bore. The ported sub includes an upper ported sleeve coupled to the upper seal bore sleeve and a lower ported sleeve coupled to the lower inner sleeve, each ported sleeve including a valve port selectively fluidly coupling the respective flow bore to a valve flow path defined by the opening sleeve and ported sub, such that the upper and lower seal bores are fluidly coupled when the opening sleeve is in an open position. The piston is mechanically coupled to the opening sleeve and defines an opening chamber.

13 Claims, 22 Drawing Sheets

(56) References Cited

U.S. PATENT DOCUMENTS

| | | | | |
|---|---|---|---|---|
| 5,957,208 | A * | 9/1999 | Schnatzmeyer | E21B 34/06 166/373 |
| 6,634,429 | B2 * | 10/2003 | Henderson | E21B 34/10 166/278 |
| 7,201,232 | B2 * | 4/2007 | Turner | E21B 34/102 166/329 |
| 7,383,884 | B1 * | 6/2008 | Turner | E21B 43/04 166/278 |
| 8,276,674 | B2 * | 10/2012 | Lopez de Cardenas | E21B 34/06 166/318 |
| 8,870,153 | B2 * | 10/2014 | Ross | E21B 34/103 166/323 |
| 9,297,232 | B2 * | 3/2016 | Scott | E21B 33/127 |
| 9,617,823 | B2 * | 4/2017 | George | E21B 33/128 |
| 9,650,851 | B2 * | 5/2017 | Whitsitt | E21B 34/14 |
| 2003/0019634 | A1 | 1/2003 | Henderson et al. | |
| 2011/0278017 | A1 | 11/2011 | Themig et al. | |
| 2011/0315389 | A1 * | 12/2011 | Crider | E21B 21/103 166/329 |
| 2012/0111574 | A1 * | 5/2012 | Desranleau | E21B 34/102 166/373 |
| 2017/0335656 | A1 | 11/2017 | Ross et al. | |
| 2018/0363420 | A1 * | 12/2018 | Ross | E21B 34/14 |

* cited by examiner

CONCENTRIC FLOW VALVE

CROSS-REFERENCE TO RELATED APPLICATIONS

This application is a non-provisional application which claims priority from U.S. provisional application Ser. No. 62/519,445, filed Jun. 14, 2017, and U.S. provisional application Ser. No. 62/643,427, filed Mar. 15, 2018, each of which is incorporated by reference herein in its entirety.

TECHNICAL FIELD/FIELD OF THE DISCLOSURE

The present disclosure relates generally to downhole tools, and specifically to downhole flow valves.

BACKGROUND OF THE DISCLOSURE

In some instances, it may be desirable to isolate different zones of a downhole formation for production. Typically, two zones of the formation may be selectively produced from by a single production string, referred to as a dual-zone completion. In a typical dual zone completion, each zone is produced from one at a time. The first zone may be produced from for a desired time period, such as, for example and without limitation, until water is produced, at which time the dual zone completion will be reconfigured to produce from the second zone. The dual zone completion typically includes a valve to switch whether production from the first or second zone occurs.

SUMMARY

The present disclosure provides for a concentric flow valve for a downhole tool. The concentric flow valve may include an outer sub, the outer sub being tubular. The concentric flow valve may include an upper seal bore sleeve positioned within the outer sub. The upper seal bore sleeve may be tubular. The annular space between the outer sub and the upper seal bore sleeve may define an upper flow bore. The concentric flow valve may include a lower inner sleeve positioned within the outer sub. The lower inner sleeve may be tubular. The annular space between the outer sub and the lower inner sleeve may define a lower flow bore. The concentric flow valve may include a ported sub mechanically coupled to the outer sub. The ported sub may separate the upper flow bore from the lower flow bore. The ported sub may include an upper ported sleeve mechanically coupled to the upper seal bore sleeve. The upper ported sleeve may include an upper valve port fluidly coupling the interior and the exterior of the upper ported sleeve. The ported sub may include a lower ported sleeve mechanically coupled to the lower inner sleeve. The lower ported sleeve may include a lower valve port fluidly coupling the interior and the exterior of the lower ported sleeve. The concentric flow valve may include an opening sleeve, the opening sleeve being tubular. The opening sleeve may be positioned within the ported sub. The opening sleeve may include an upper flange and a lower flange. The upper flange and lower flange may define a radial depression in the outer surface of the opening sleeve. The radial depression and ported sub may define an inner wall of a valve flow path. The valve flow path may be fluidly coupled to the upper and lower flow bores when the opening sleeve is in an open position. The concentric flow valve may include a piston positioned within the upper seal bore sleeve. The piston may be mechanically coupled to the opening sleeve. The piston and upper seal bore sleeve may define an opening cylinder fluidly coupled to the upper flow bore.

The present disclosure also provides for a method. The method may include providing a concentric flow valve. The concentric flow valve may include an upper seal bore sleeve positioned within the outer sub. The upper seal bore sleeve may be tubular. The annular space between the outer sub and the upper seal bore sleeve may define an upper flow bore. The concentric flow valve may include a lower inner sleeve positioned within the outer sub. The lower inner sleeve may be tubular. The annular space between the outer sub and the lower inner sleeve may define a lower flow bore. The concentric flow valve may include a ported sub mechanically coupled to the outer sub. The ported sub may separate the upper flow bore from the lower flow bore. The ported sub may include an upper ported sleeve mechanically coupled to the upper seal bore sleeve. The upper ported sleeve may include an upper valve port fluidly coupling the interior and the exterior of the upper ported sleeve. The ported sub may include a lower ported sleeve mechanically coupled to the lower inner sleeve. The lower ported sleeve may include a lower valve port fluidly coupling the interior and the exterior of the lower ported sleeve. The concentric flow valve may include an opening sleeve, the opening sleeve being tubular. The opening sleeve may be positioned within the ported sub. The opening sleeve may include an upper flange and a lower flange. The upper flange and lower flange may define a radial depression in the outer surface of the opening sleeve. The radial depression and ported sub may define an inner wall of a valve flow path. The valve flow path may be fluidly coupled to the upper and lower flow bores when the opening sleeve is in an open position. The concentric flow valve may include a piston positioned within the upper seal bore sleeve. The piston may be mechanically coupled to the opening sleeve. The piston and upper seal bore sleeve may define an opening cylinder fluidly coupled to the upper flow bore. The method may include increasing the pressure within an interior of the concentric flow valve, causing a differential pressure between the interior of the concentric flow valve and the opening cylinder, shifting the piston into an actuated position; and shifting the opening sleeve into an open position such that the valve flow path is aligned with the upper and lower valve ports

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
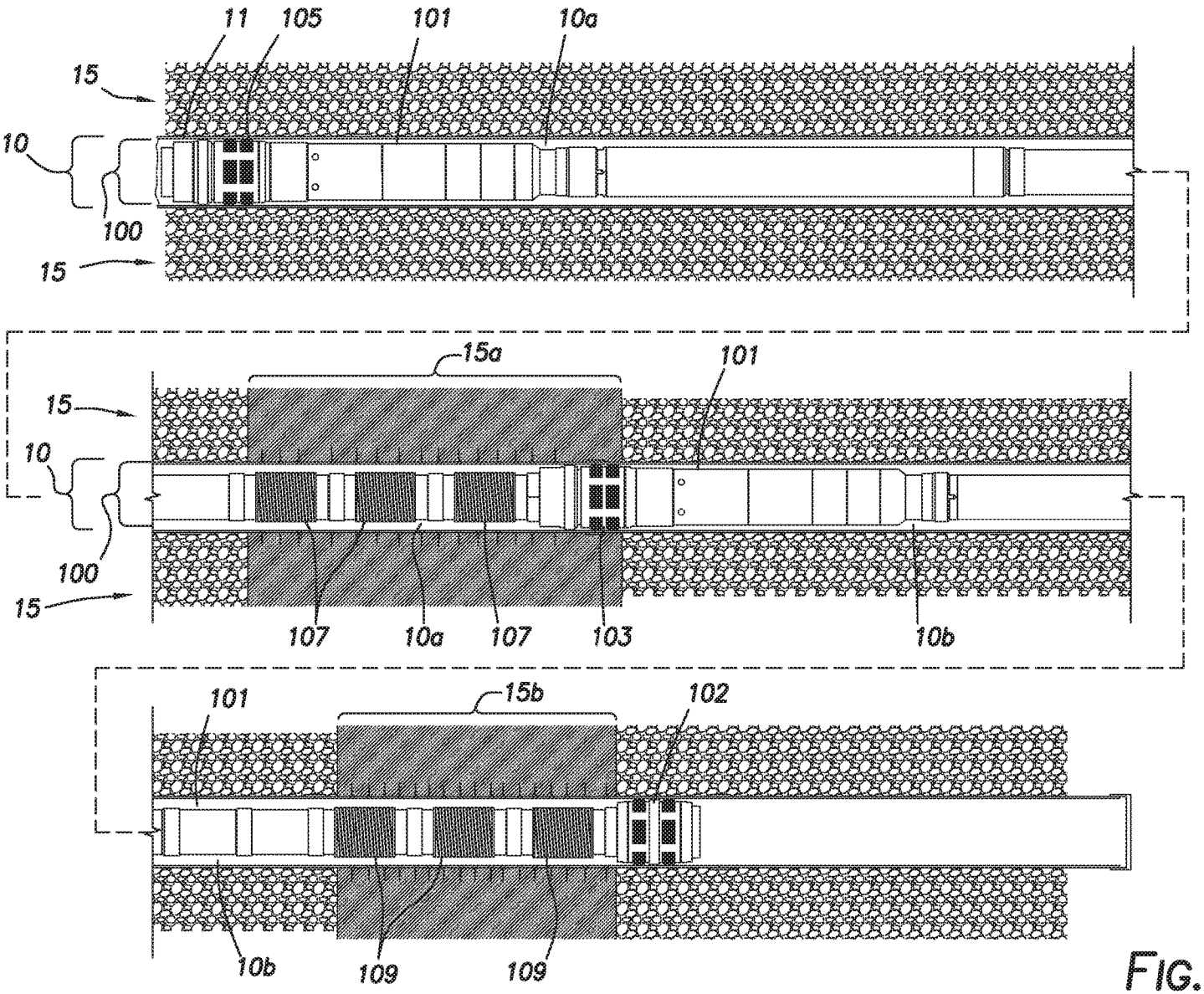
FIG. 1 depicts a dual zone completion assembly that includes a concentric flow valve consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts wellbore 10. Wellbore 10 may be formed in formation 15 by, for example and without limitation, a drilling operation. In some embodiments, wellbore 10 may include casing string 11. Formation 15 may include upper producing formation 15*a* and lower producing formation 15*b*. Dual zone completion assembly 100 may be positioned within wellbore 10. Dual zone completion assembly 100 may be designed to selectively produce fluids from upper producing formation 15*a* and lower producing formation 15*b*. In some embodiments, dual zone completion assembly 100 may include outer housing 101. Outer housing 101 may be tubular and may be part of a completion string. Outer housing 101 may, in some embodiments, be made up of multiple subunits as described herein and otherwise. In some embodiments, dual zone completion assembly 100 may include sump packer 102, lower zone packer 103, and upper zone packer 105 positioned to isolate upper zone 10*a* and lower zone 10*b* from each other and from the rest of wellbore 10. In some embodiments, upper zone 10*a* and lower zone 10*b* of wellbore 10 may correspond to upper producing formation 15*a* and lower producing formation 15*b* of formation 15. In some embodiments, dual zone completion assembly 100 may include upper zone screens 107 and lower zone screens 109 that fluidly couple upper zone 10*a* and lower zone 10*b* respectively with the interior of dual zone completion assembly 100. In some embodiments, dual zone completion assembly may be made up of multiple subcomponents that are run into wellbore 10 separately and are mechanically coupled within wellbore 10.

Figure 2A:
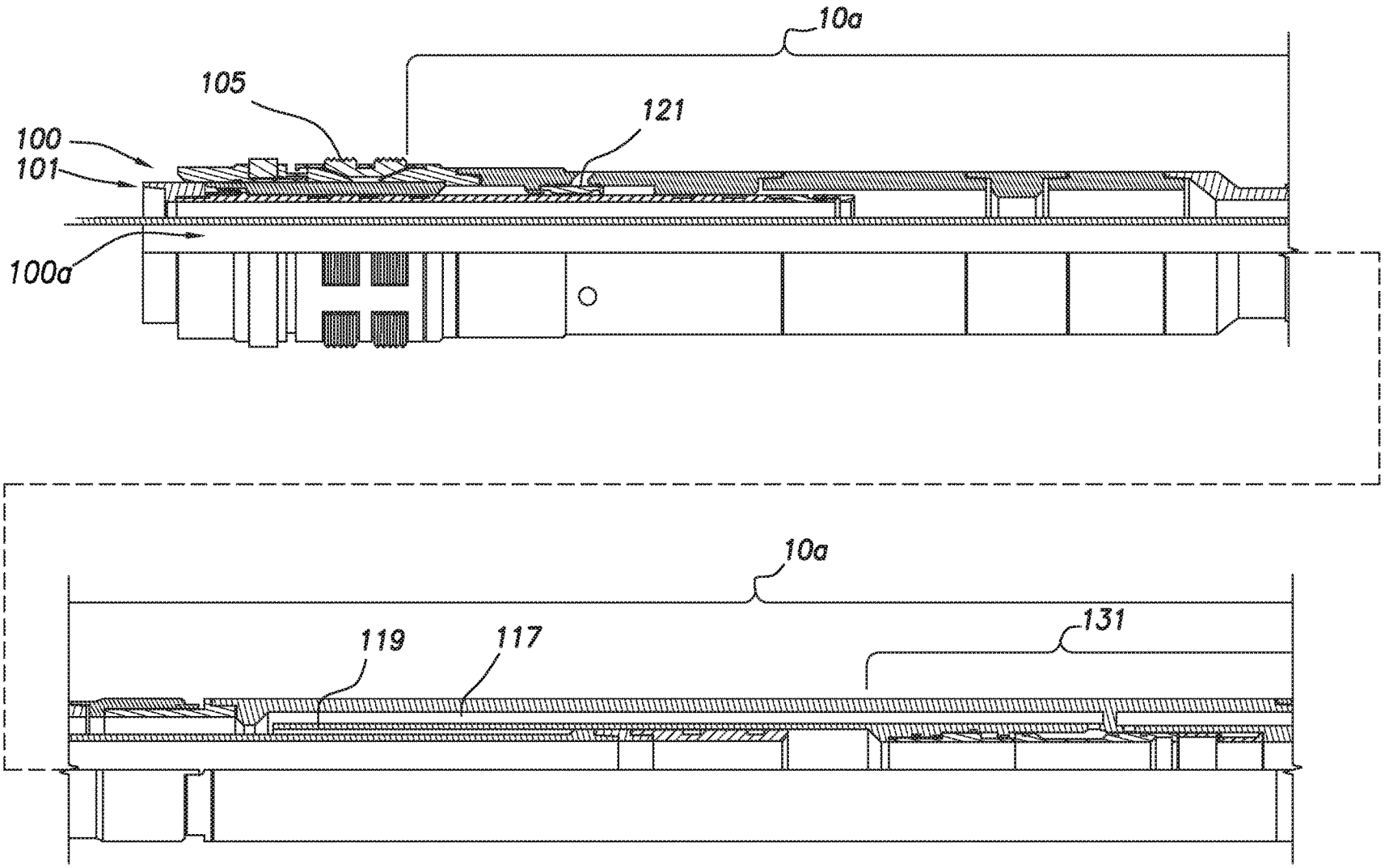
FIGS. 2A-2C depict a partial cross-section view of a dual zone completion assembly that includes a concentric flow valve consistent with at least one embodiment of the present disclosure.
Figure 2B:
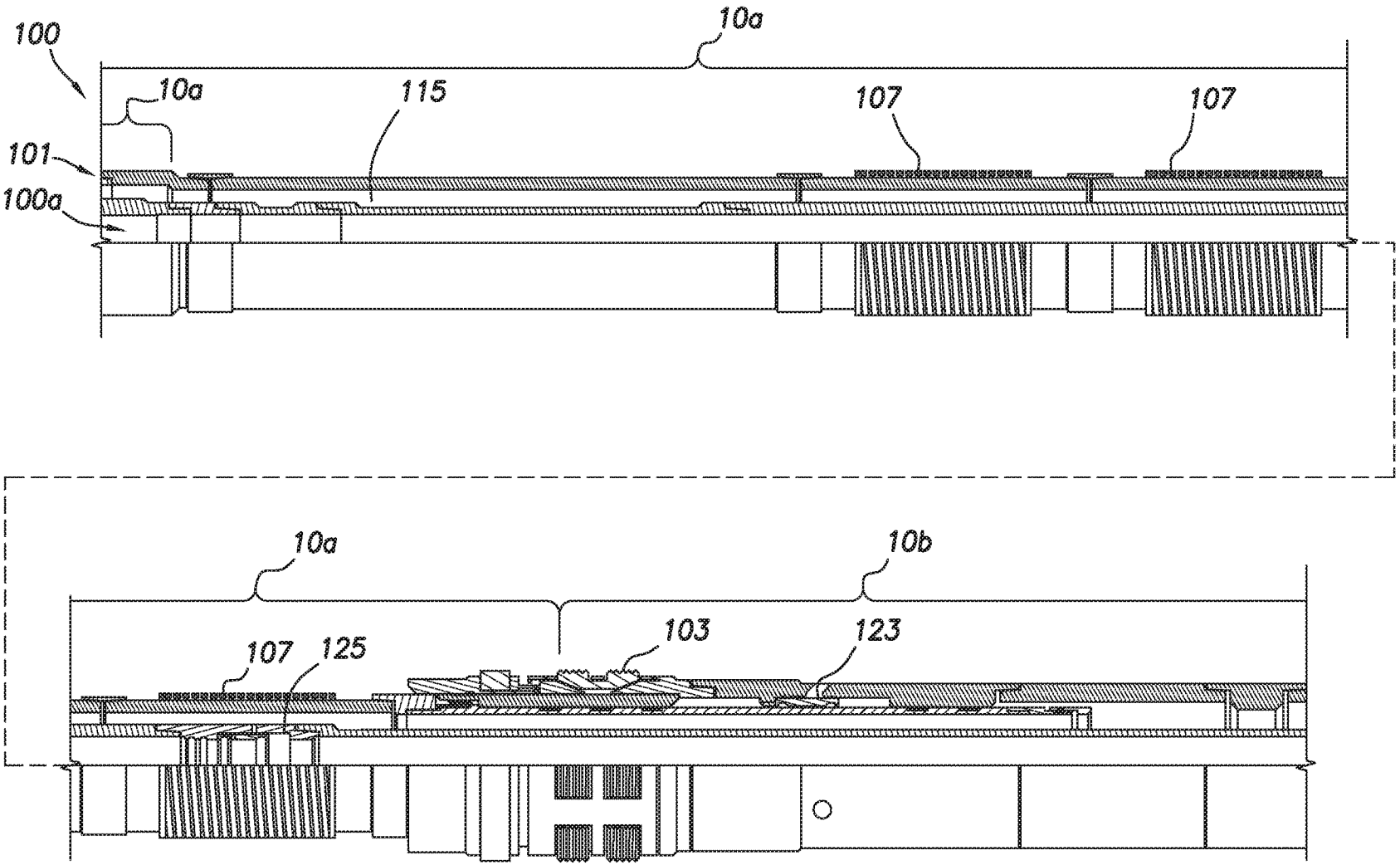
Figure 2C:
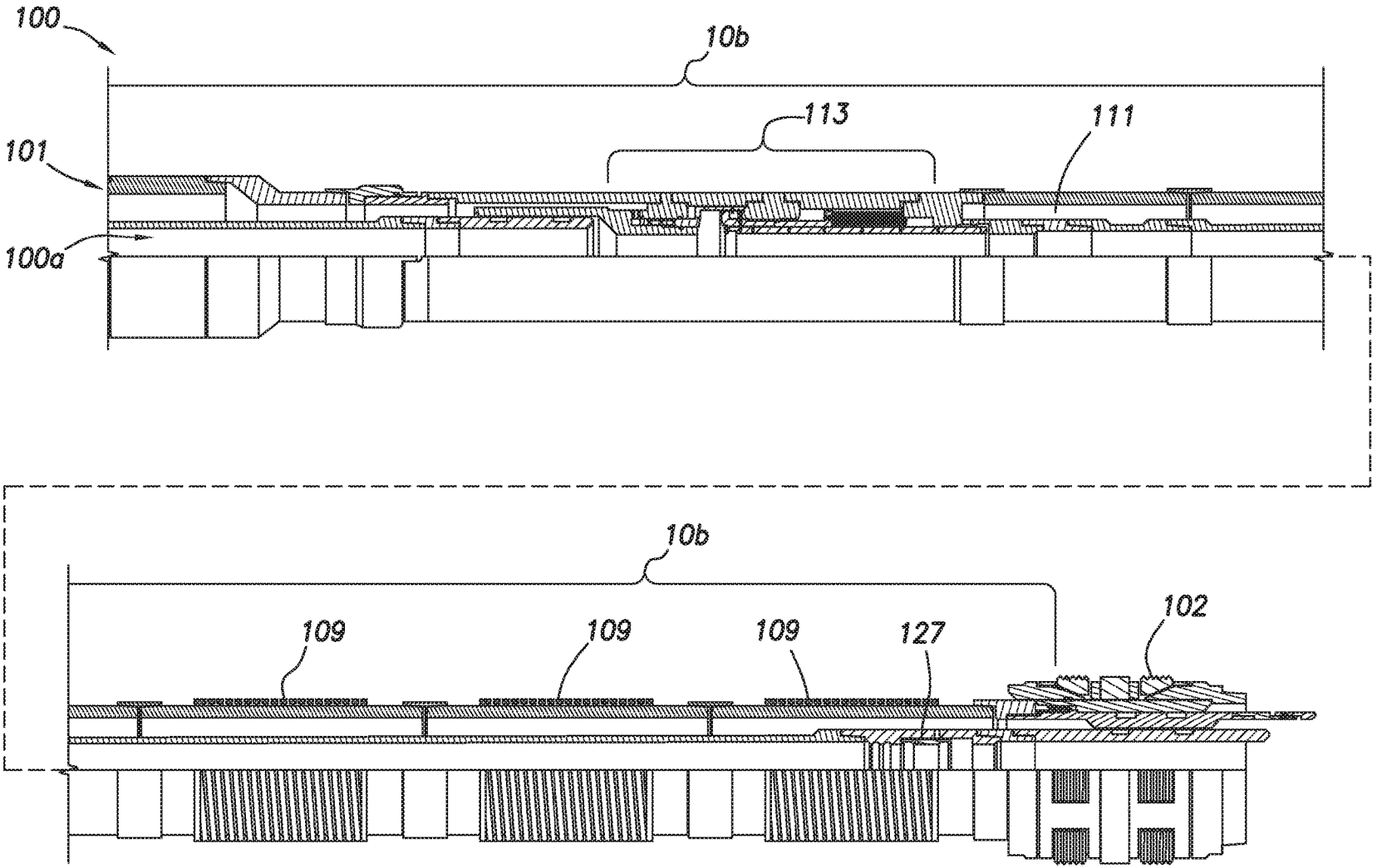

As depicted in FIGS. 2A-2C, lower zone screens 109 may fluidly couple to lower zone flow annulus 111. Lower zone flow annulus 111 may be selectively fluidly coupled or uncoupled from central bore 100*a* of dual zone completion assembly 100 by lower production valve 113. Lower production valve 113 may, in some embodiments, be a slow-pressure triggered radial valve (SPT valve) as described in U.S. patent application Ser. No. 15/589,365, filed May 8, 2017, hereby incorporated by reference in its entirety.

Figure 3A:
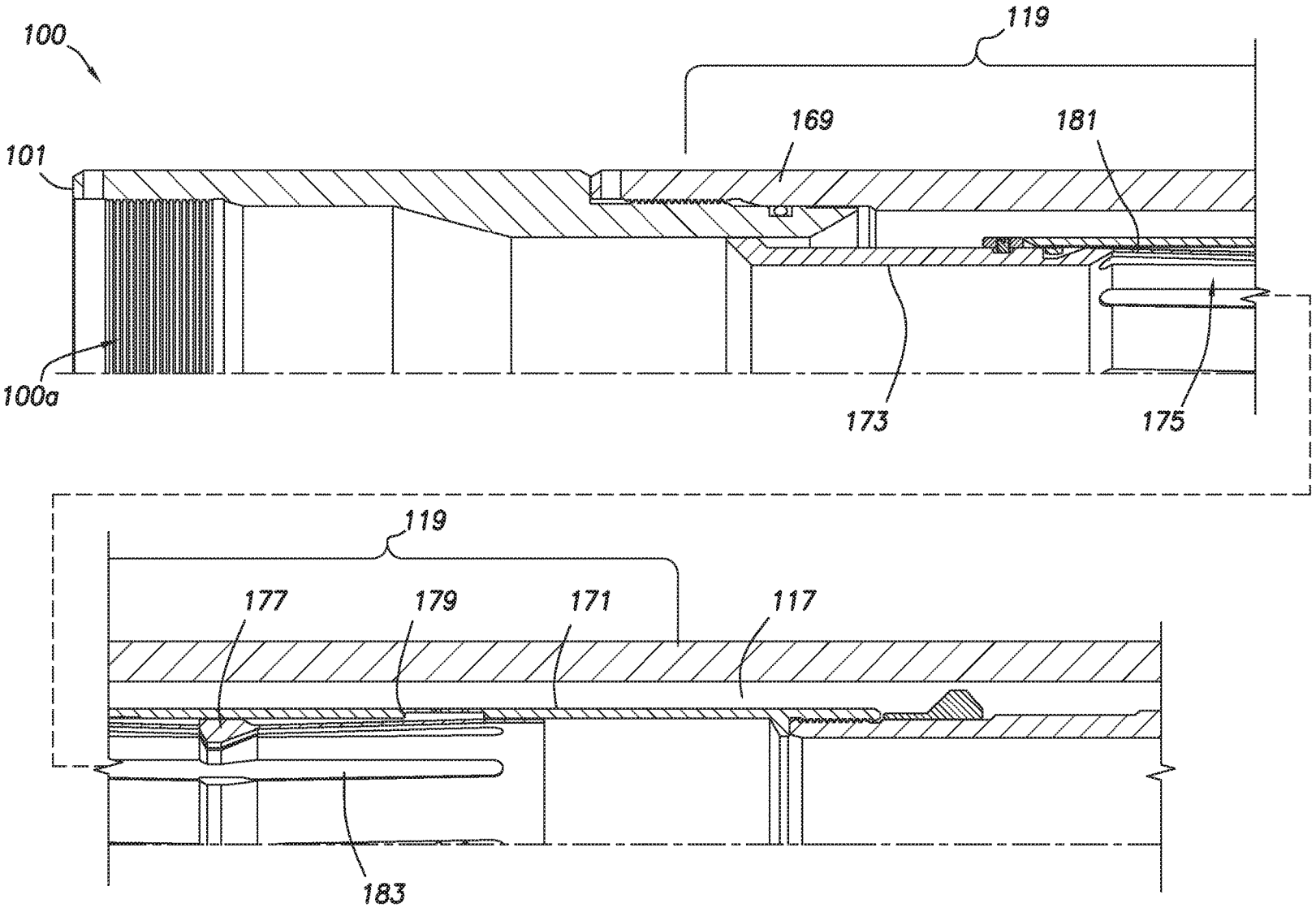
FIGS. 3A-3C depict a cross section view of a concentric flow valve consistent with at least one embodiment of the present disclosure in a run-in configuration.
Figure 3B:
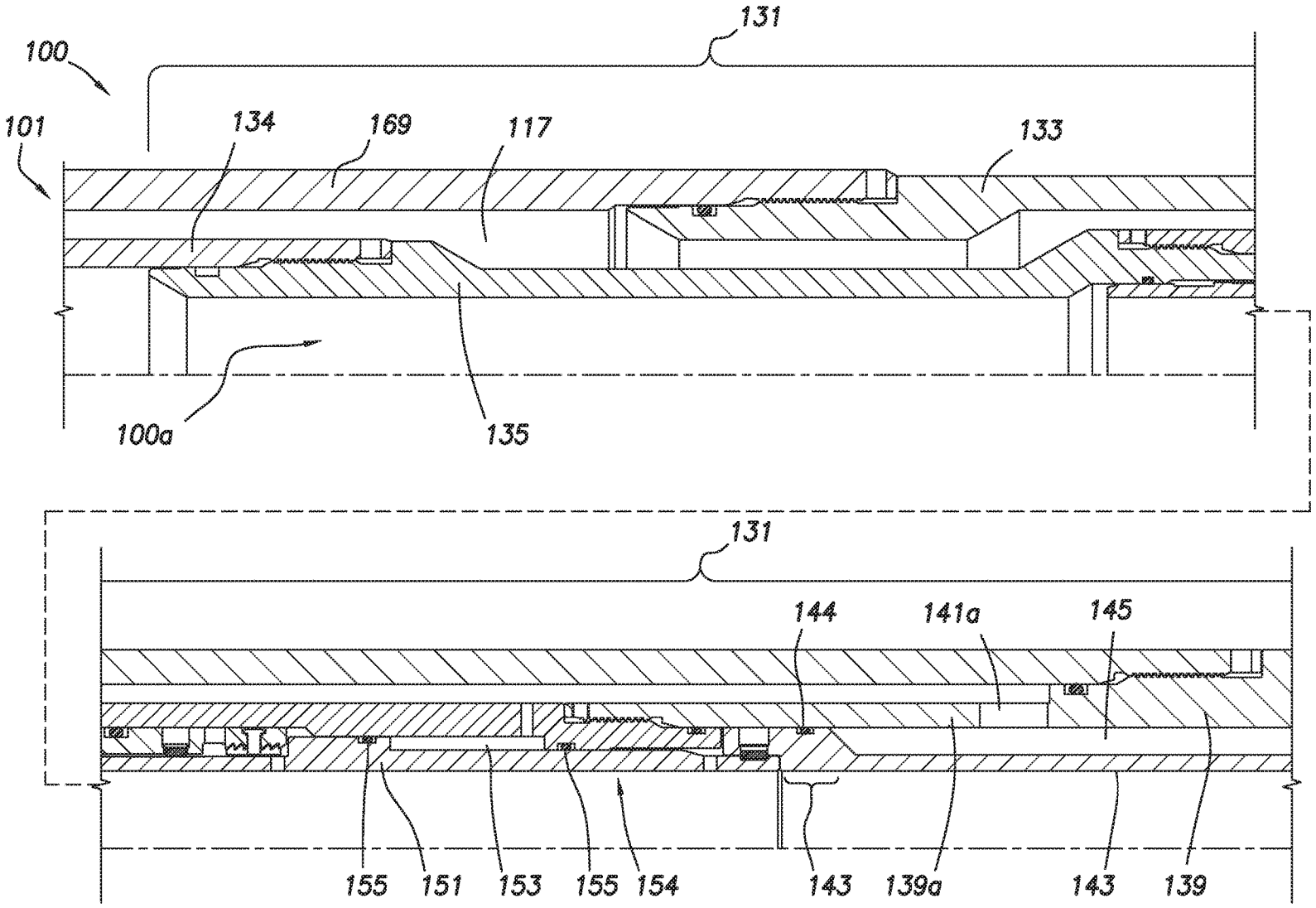
Figure 3C:
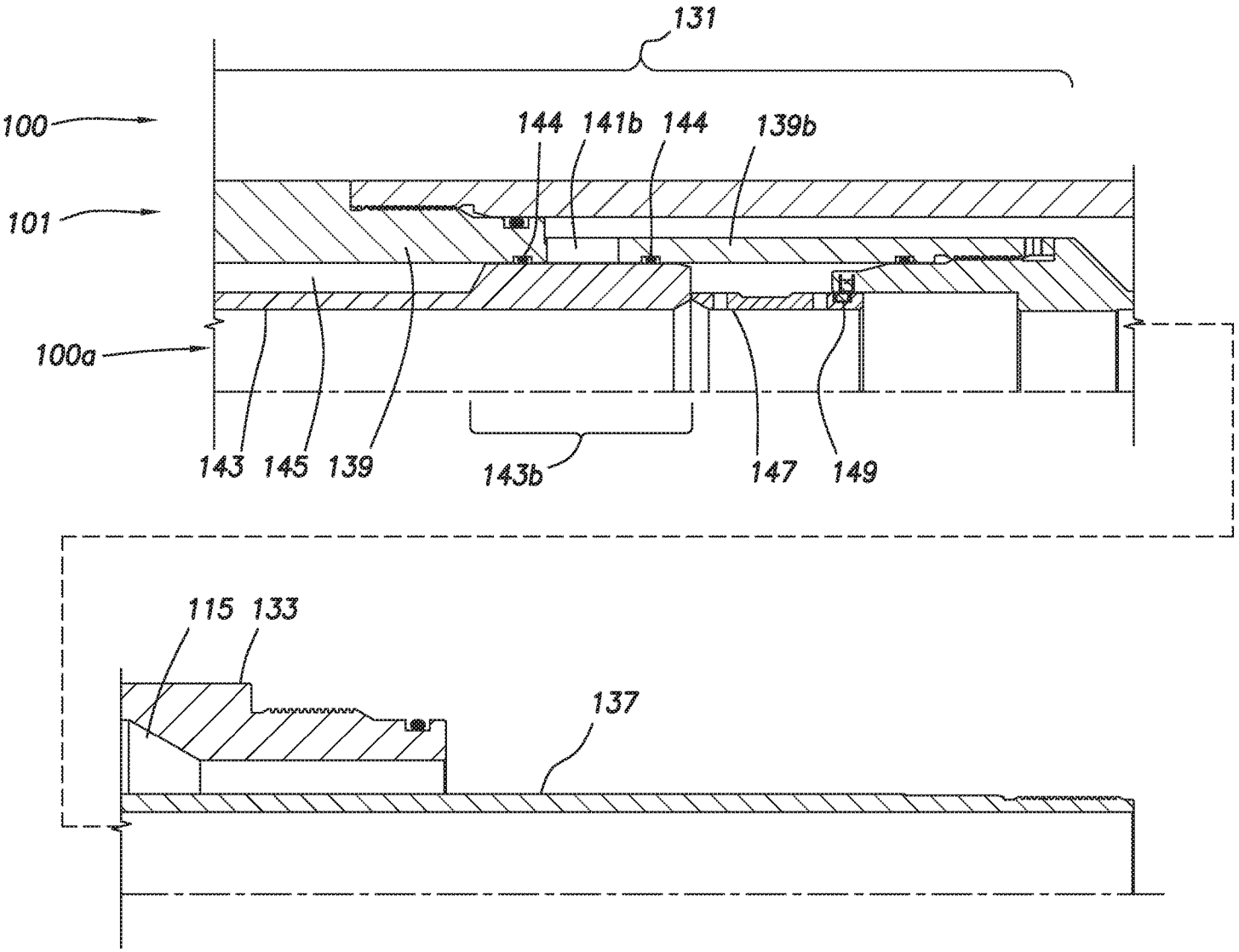
Figure 4A:
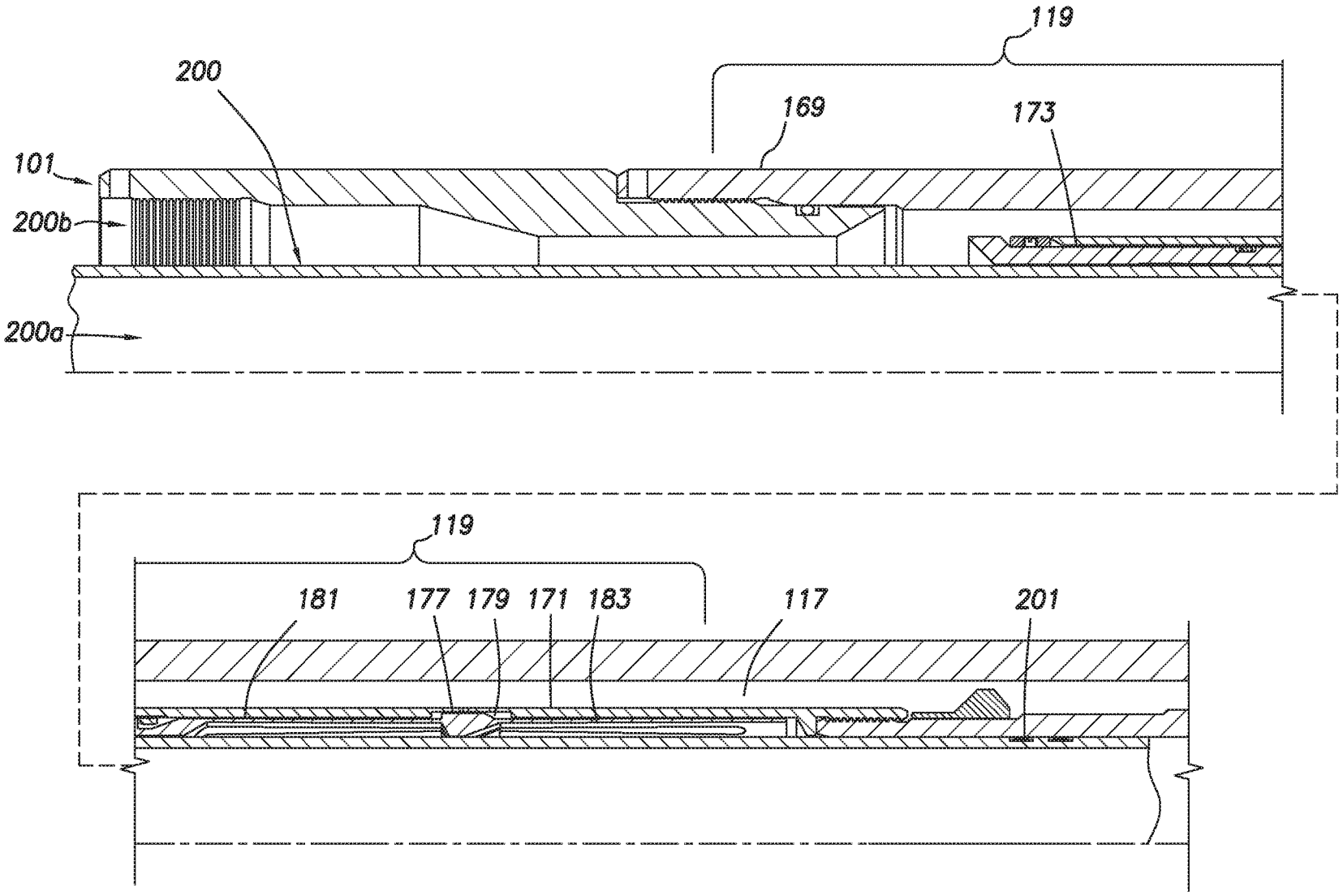
FIGS. 4A-4C depict a cross section view the concentric flow valve of FIGS. 3A-3C in an open configuration.
Figure 4B:
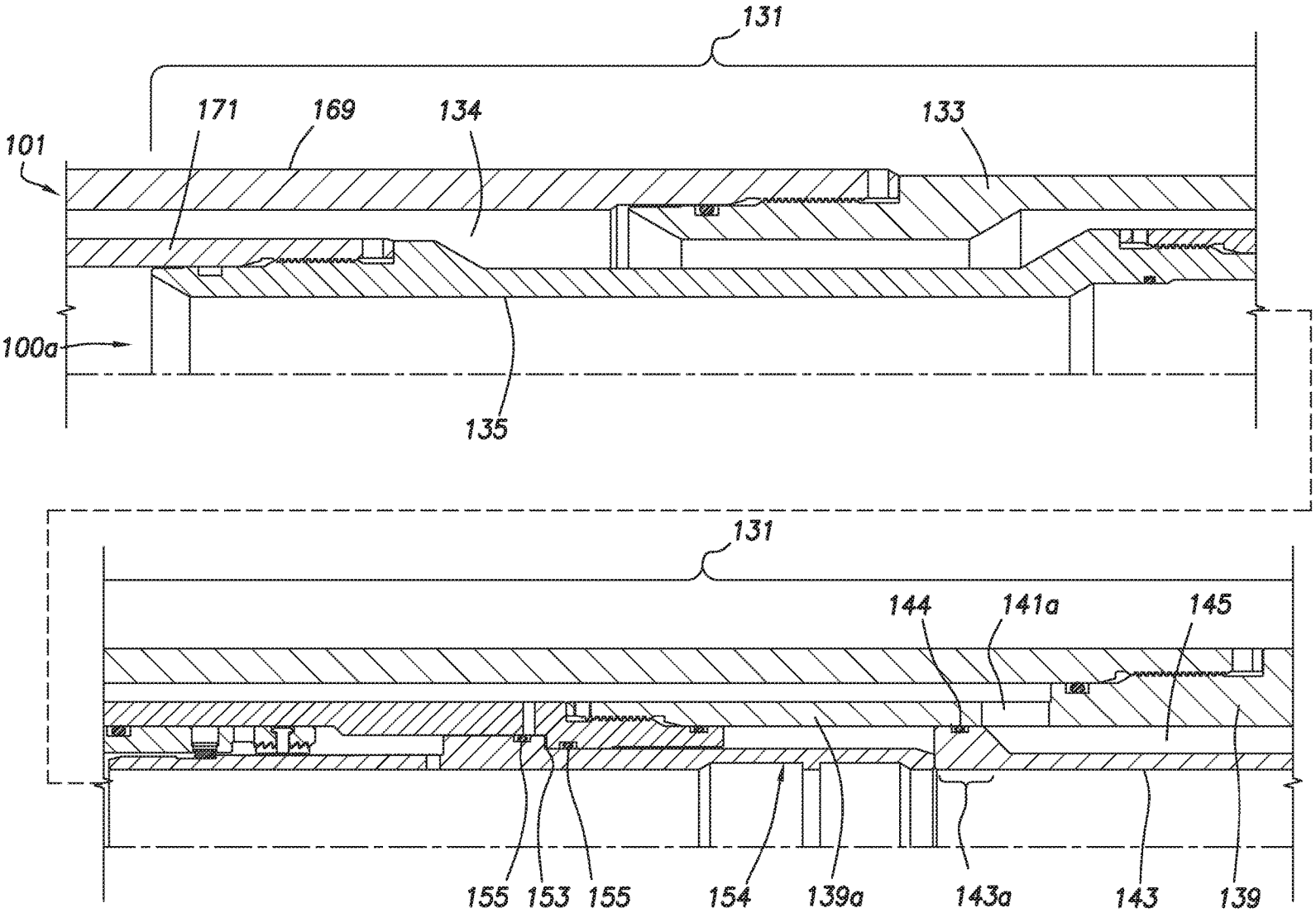
Figure 4C:
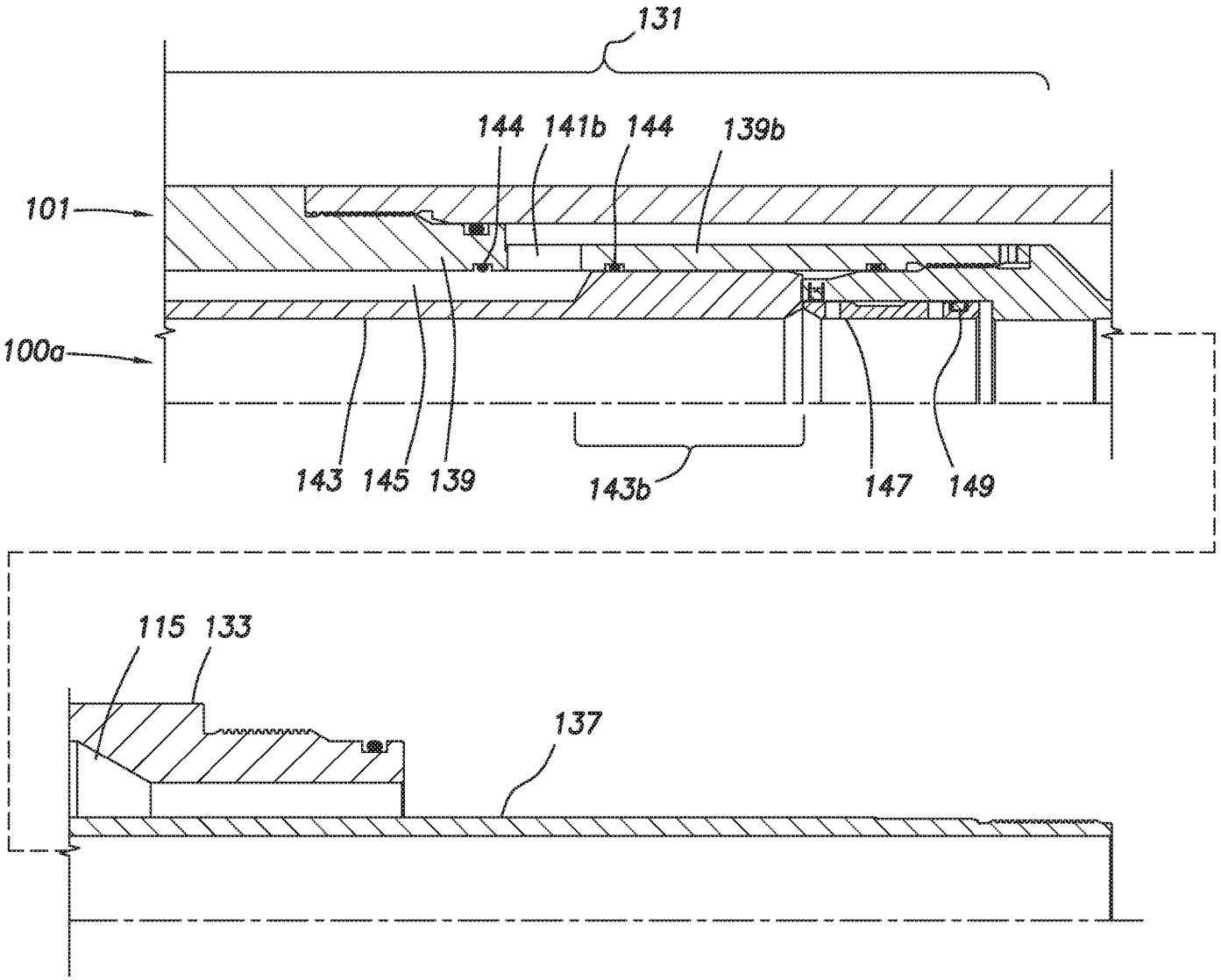

Upper zone screens 107 may fluidly couple to lower flow bore 115. Lower flow bore 115 may be selectively fluidly coupled or uncoupled from upper flow bore 117 by concentric flow valve (CFV) 131, also defined as an annular flow valve. For the purposes of this disclosure, when CFV 131 is configured such that lower flow bore 115 is fluidly decoupled from upper flow bore 117, CFV 131 is defined as being in a run in configuration as depicted in FIGS. 3A-3C. When CFV 131 is configured such that lower flow bore 115 is fluidly coupled to upper flow bore 117, CFV 131 is defined as being in an open configuration as depicted in FIGS. 4A-4C.

Upper flow bore 117 may be selectively coupled or uncoupled from central bore 100*a* of dual zone completion assembly 100 by dirt valve 119. In some embodiments, dirt valve 119 may, for example and without limitation, prevent solids from accumulating in upper flow bore 117 during running and gravel packing operations. In some embodiments, dirt valve 119 may allow fluid leakage between central bore 100*a* and upper flow bore 117. In some embodiments, dual zone completion assembly 100 may include upper frac valve 121 and lower frac valve 123, which may be used during fracing or gravel packing operations of upper zone 10*a* and lower zone 10*b* respectively. In some embodiments, dual zone completion assembly 100 may include mechanical sleeve valves 125, 127 to allow mechanical intervention to fluidly couple or decouple lower flow bore 115 or lower zone flow annulus 111, respectively, from central bore 100*a* of dual zone completion assembly 100 to, for example and without limitation, allow returns of fluid during or after a frac procedure.

In some embodiments, as depicted in FIGS. 3A-3C and 4A-4C, CFV 131 may include outer sub 133. In some embodiments, outer sub 133 may be included as part of outer housing 101 of dual zone completion assembly 100. Outer sub 133 may be made up of multiple subcomponents. Outer sub 133 may be tubular and may form an outer wall of lower flow bore 115 and upper flow bore 117. CFV 131 may include seal bore 134. CFV 131 may include upper seal bore sleeve 135. Upper seal bore sleeve 135 may mechanically couple to seal bore 134. Upper seal bore sleeve 135 and seal bore 134 may form an inner wall of upper flow bore 117. CFV 131 may include lower inner sleeve 137. Lower inner sleeve 137 may form an inner wall of lower flow bore 115.

In some embodiments, CFV 131 may include ported sub 139. In some embodiments, ported sub 139 may extend radially inward from outer sub 133. In some embodiments, ported sub 139 may be mechanically coupled to outer sub 133 but may extend further radially inward than outer sub 133. Ported sub 139 may include upper ported sleeve 139*a* and lower ported sleeve 139*b*. Upper ported sleeve 139*a* may mechanically couple to upper seal bore sleeve 135 and fluidly seal thereto. Lower ported sleeve 139*b* may mechanically couple to lower inner sleeve 137 and fluidly seal thereto. Ported sub 139 may therefore separate upper flow bore 117 from lower flow bore 115.

In some embodiments, upper ported sleeve 139*a* may include one or more upper valve ports 141*a*. Upper valve ports 141*a* may fluidly couple between the interior and exterior of upper ported sleeve 139*a*. In some embodiments, lower ported sleeve 139*b* may include one or more lower valve ports 141*b*. Lower valve ports 141*b* may fluidly couple between the interior and exterior of lower ported sleeve 139*b*.

In some embodiments, CFV 131 may include opening sleeve 143. Opening sleeve 143 may be tubular and positioned within ported sub 139. Opening sleeve 143 may be slidable longitudinally relative to ported sub 139 from a closed position (as depicted in FIGS. 3A-3C) to an open position (as depicted in FIGS. 4A-4C) as discussed further herein below. In some embodiments, one or more seals 144 may be positioned between opening sleeve 143 and ported sub 139. In some embodiments, opening sleeve 143 may include upper flange 143*a* and lower flange 143*b*. Upper flange 143*a* may be annular in shape and may engage an inner surface of upper ported sleeve 139*a* and may fluidly seal thereto. Lower flange 143*b* may be annular in shape and may engage an inner surface of lower ported sleeve 139*b*. Opening sleeve 143 may therefore be spool-shaped and may include a radial depression along the outer surface of opening sleeve 143 between upper flange 143*a* and lower flange 143*b*. The radial depression of the outer wall of opening sleeve 143 may define an inner wall of valve flow path 145, wherein the outer wall of valve flow path 145 is defined by the inner wall of ported sub 139.

In some embodiments, CFV 131 may include shear sleeve 147. Shear sleeve 147 may mechanically couple to lower inner sleeve 137 by one or more temporary retainers 149. Temporary retainers 149 may include one or more of a shear bolt, shear pin, shear screw, shear wire, C-clip, or other fastener or retainer adapted to retain shear sleeve 147 to lower inner sleeve 137 until a force is exerted on shear sleeve 147 sufficient to overcome temporary retainers 149, allowing shear sleeve 147 to move longitudinally relative to lower inner sleeve 137. In some embodiments, shear sleeve 147 may abut opening sleeve 143. In some embodiments, shear sleeve 147 may maintain opening sleeve 143 in the closed position while temporary retainers 149 couple shear sleeve 147 to lower inner sleeve 137.

In some embodiments, CFV 131 may include opening piston 151. Opening piston 151 may be positioned within upper seal bore sleeve 135. Opening piston 151 may be slidable relative to upper seal bore sleeve 135. A portion of the outer wall of opening piston 151 may define an inner wall of opening cylinder 153, wherein the outer wall of opening cylinder 153 may be defined by upper seal bore sleeve 135. Opening piston 151 may be fluidly sealed to upper seal bore sleeve 135 by one or more seals 144. In some embodiments, opening cylinder 153 may be in fluid communication with upper flow bore 117.

In some embodiments, opening piston 151 may abut opening sleeve 143. In other embodiments, opening piston 151 may be formed integrally with opening sleeve 143. In other embodiments, opening piston 151 may be mechanically coupled to opening sleeve 143 by a retainer such as, for example and without limitation, a snap ring, set screw, or threaded connection.

In some embodiments, opening piston 151 may be slidable between a run in position (as depicted in FIGS. 3A-3C) and an activated position (as depicted in FIGS. 4A-4C). In some embodiments, in order to transition CFV 131 from the run-in configuration to the open configuration, fluid pressure within central bore 100*a* may be increased while fluid pressure within upper flow bore 117 is maintained at the hydrostatic pressure within central bore 100*a* before pressure is increased. The pressure differential between central bore 100*a* and opening cylinder 153 may exert a force on opening piston 151 to urge it from the run in position toward the activated position. In some embodiments, because opening piston 151 abuts opening sleeve 143, the force on opening piston 151 is transferred to opening sleeve 143. In some embodiments, the force on opening sleeve 143 is transferred to shear sleeve 147 and onto temporary retainers 149. In some embodiments, once the pressure differential is high enough, the force exerted on temporary retainers 149 is sufficient to release shear sleeve 147 from lower inner sleeve 137, allowing opening piston 151, opening sleeve 143, and shear sleeve 147 to slide longitudinally in response to the force from the pressure differential such that CFV 131 transitions to the open configuration as depicted in FIGS. 4A-4C.

When opening sleeve 143 is in the closed position, fluid flow between lower flow bore 115 and upper flow bore 117 through valve flow path 145 is restricted or prevented because valve flow path 145 is not aligned with one or both of upper valve ports 141*a* and lower valve ports 141*b*. For example, as depicted in FIG. 3C, lower flange 143*b* is positioned in alignment with lower valve ports 141*b*, thereby restricting or reducing fluid flow between lower flow bore 115 and valve flow path 145. When opening sleeve 143 is in the open position as depicted in FIGS. 4B-4C, valve flow path 145 is aligned with both lower valve ports 141*b* and upper valve ports 141*a*, allowing fluid communication between lower flow bore 115 and upper flow bore 117 through valve flow path 145.

Figure 5A:
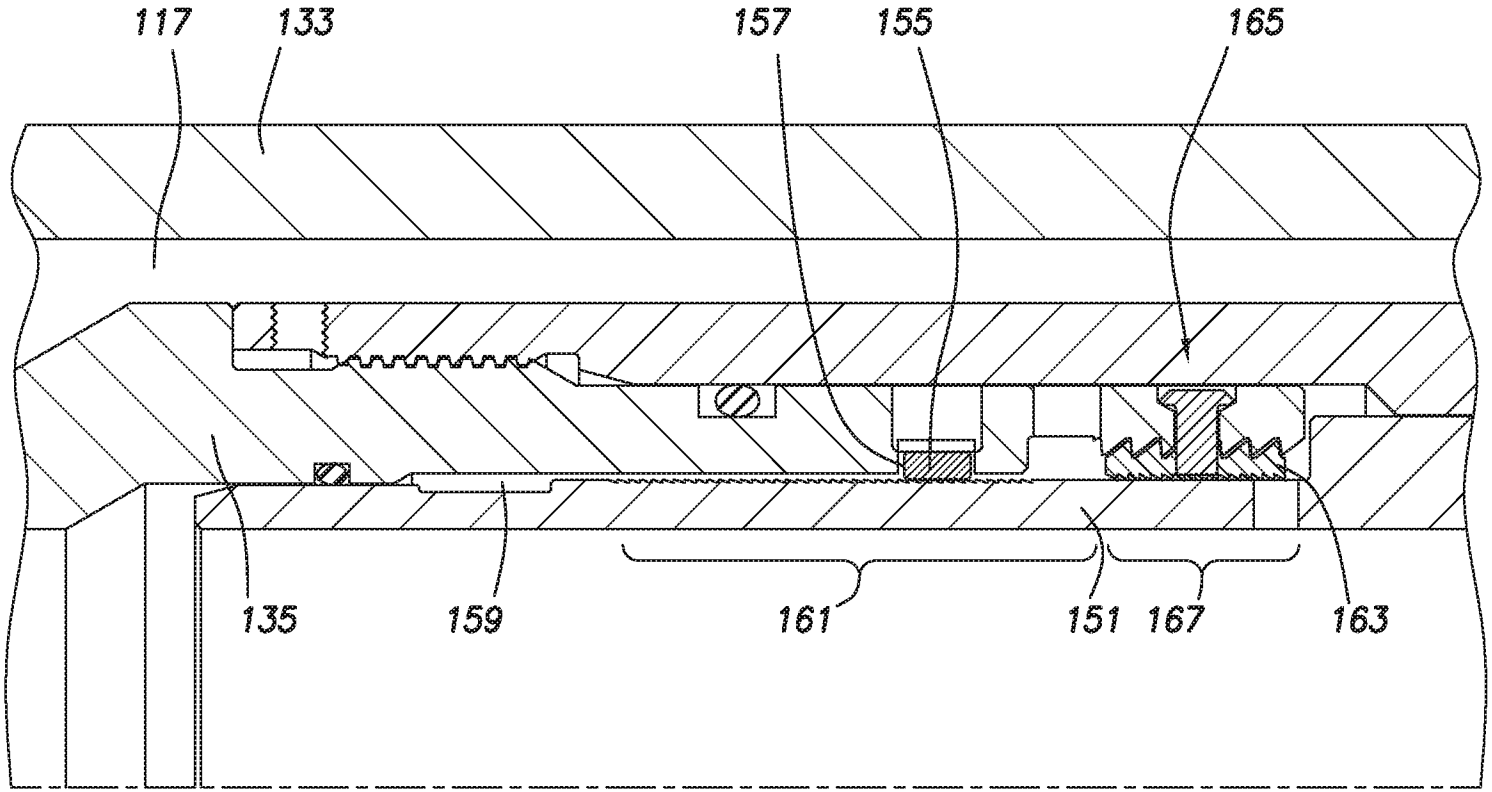
FIGS. 5A, 5B depict detail cross section views of the concentric flow valve of FIGS. 3A-3C.
Figure 5B:
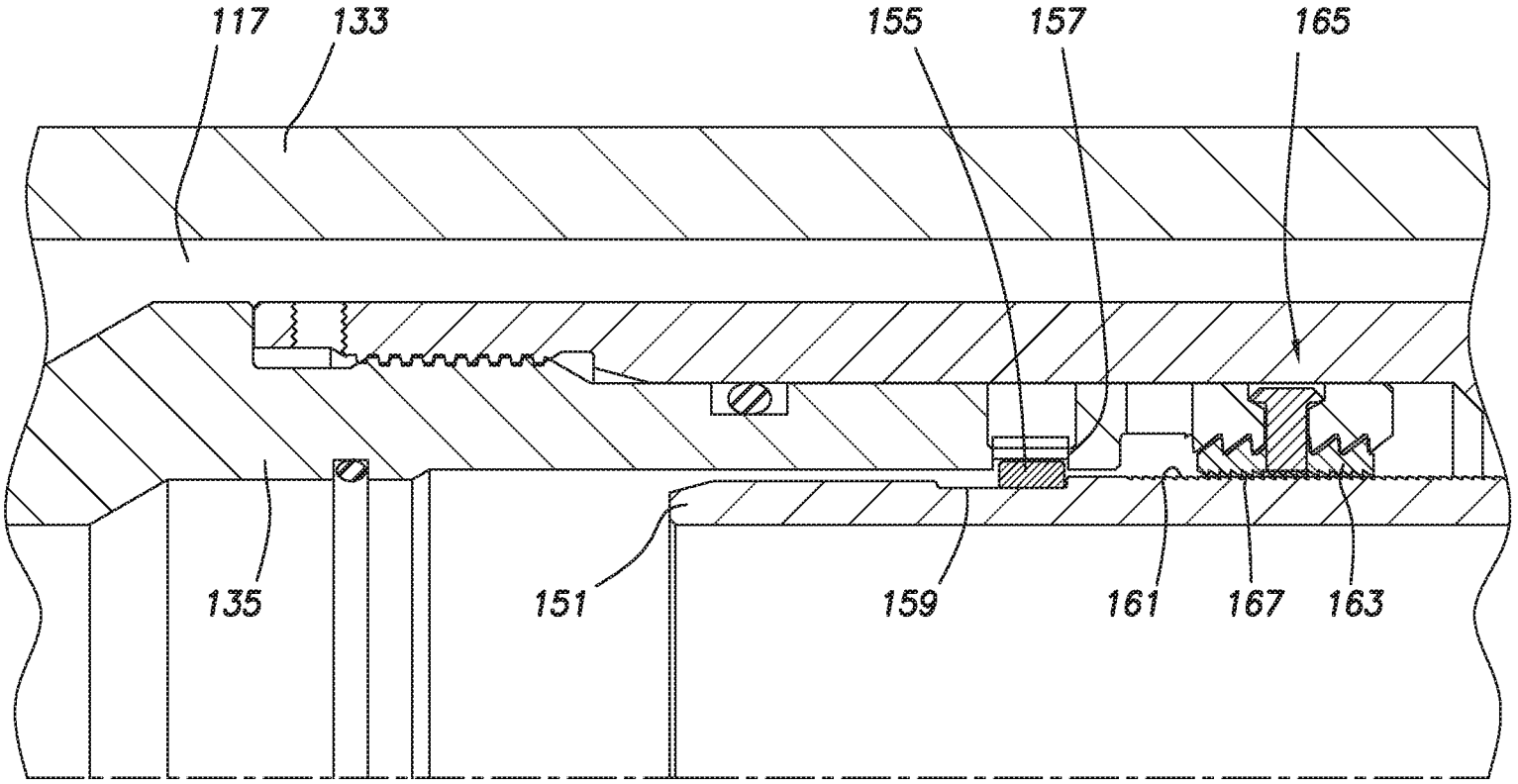

In some embodiments, one or more locking features may be positioned within CFV 131 to maintain opening sleeve 143 in the open position. For example, in some embodiments, as depicted in detail in FIGS. 5A, 5B, C-clip 155 may be positioned about opening piston 151 within C-clip recess 157 formed in upper seal bore sleeve 135. When opening piston 151 moves to the activated position, C-clip 155 may enter C-clip detent 159 formed in an outer surface of opening piston 151 due to spring tension within C-clip 155, thereby preventing or reducing further movement of opening piston 151.

In some embodiments, one or more piston ratchet teeth 161 may be formed on an outer surface of opening piston 151. Ratchet pawl 163 may be positioned about opening piston 151 within ratchet recess 165 formed in upper seal bore sleeve 135. Ratchet pawl 163 may include interior ratchet teeth 167 and may be springedly coupled to ratchet recess 165 such that as opening piston 151 moves to the activated position, piston ratchet teeth 161 may engage with interior ratchet teeth 167, allowing further motion of opening piston 151 toward the activated position while preventing or reducing movement of opening piston 151 away from the activated position.

Figure 6A:
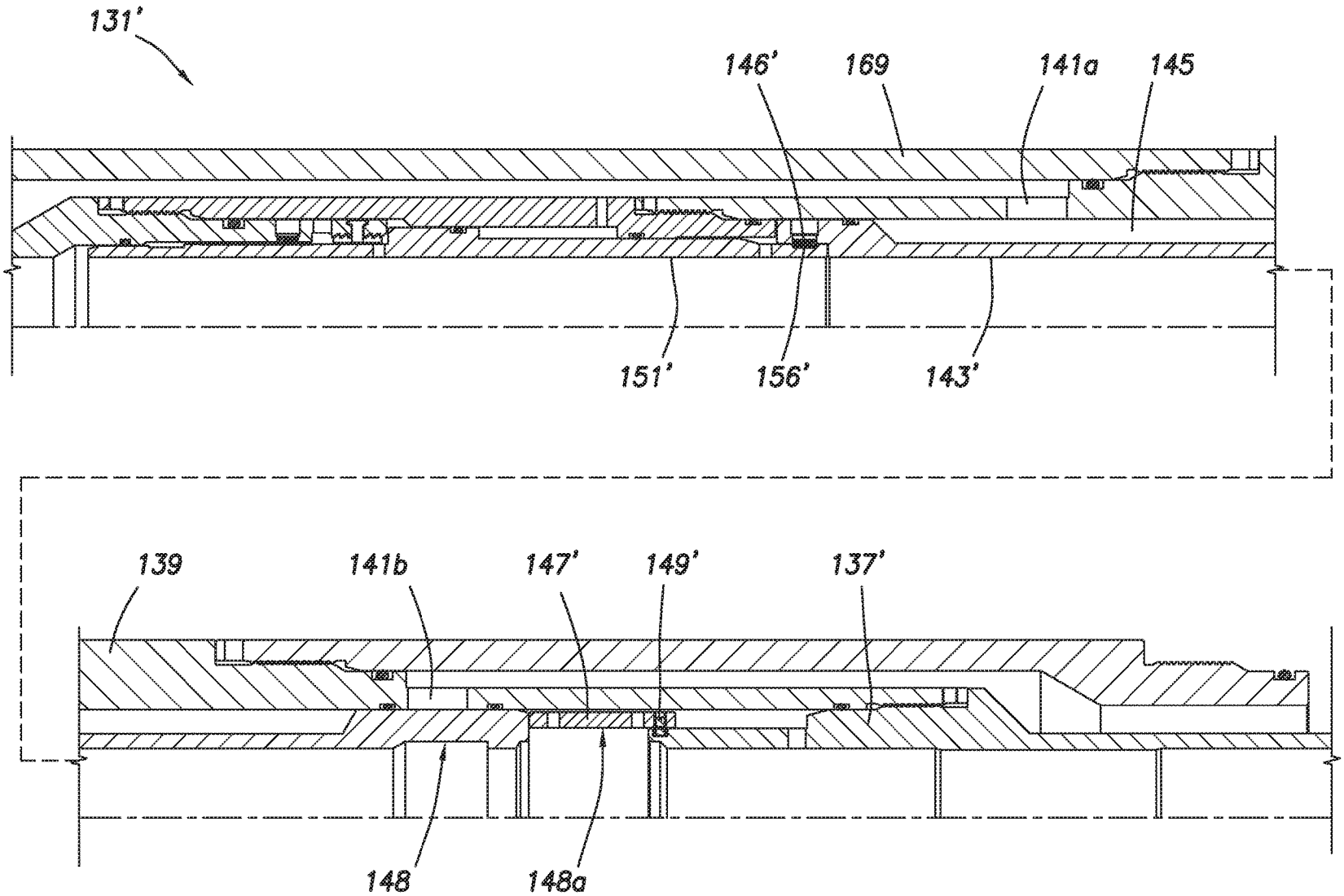
FIG. 6A, 6B depict cross section views of a concentric flow valve consistent with at least one embodiment of the present disclosure.
Figure 6B:
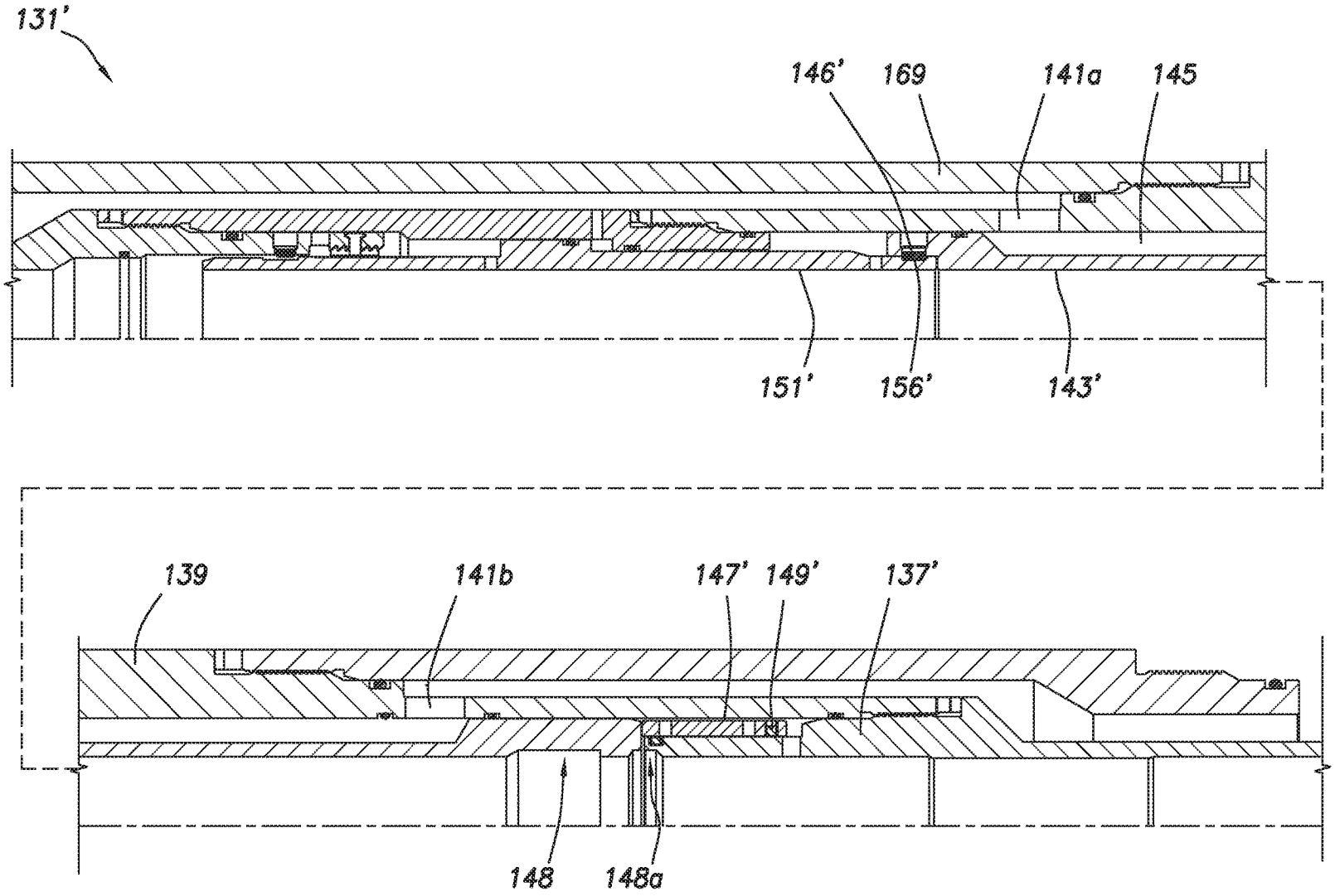

In some cases, such as where a hydraulic opening fails, CFV 131 may be openable mechanically. For example, in some embodiments as depicted in FIGS. 3A-3C and 4A-4C, opening piston 151 may include mechanical opening profile 154. Mechanical opening profile 154 may be used, for example and without limitation, to receive a shifting tool in order to shift opening piston 151 and therefore mechanically open CFV 131. In other embodiments, as depicted in FIGS. 6A, 6B, opening sleeve 143' of CFV 131' may include mechanical shifting profile 148. In some such embodiments, opening sleeve 143' may be mechanically coupled to opening piston 151' by fastener 146' as depicted in FIG. 6A. Fastener 146' may, for example and without limitation, be a snap ring, C-clip, bolt, threaded connection, or other connection. Fastener 146' may transfer movement between opening sleeve 143' and opening piston 151' when CFV 131' is mechanically opened. Fastener 146' may be positioned at least partially within fastener groove 156' formed in an outer surface of opening piston 151' to mechanically couple opening sleeve 143' to opening piston 151'. Shifting tool may engage mechanical shifting profile 148 and urge opening sleeve 143' into the open position. Fastener 146' may retain opening piston 151' to opening sleeve 143' to pull opening piston 151' into the activated position as discussed herein above as opening sleeve 143' moves into the open position depicted in FIG. 6B. In some embodiments, shear sleeve 147' may be positioned radially about lower inner sleeve 137'. In such an embodiment, as opening sleeve 143' is biased by the shifting tool, temporary retainer 149' may release shear sleeve 147' from lower inner sleeve 137'. In some embodiments, because lower groove 148*a* of mechanical shifting profile 148 is closed when opening sleeve 143' is in the open position, any shifting tools run after CFV 131' is in the open position will not engage mechanical shifting profile 148 and may be used to operate other tools further downhole.

In some embodiments, dirt valve 119 may include dirt valve outer sub 169. Dirt valve outer sub 169 may be formed as part of outer housing 101. In some embodiments, dirt valve outer sub 169 may be mechanically coupled to outer sub 133 of CFV 131. In some embodiments, dirt valve 119 may include dirt valve sleeve 171 positioned within dirt valve outer sub 169. In some embodiments, dirt valve sleeve 171 may mechanically couple to seal bore 134. In some embodiments, dirt valve sleeve 171 and dirt valve outer sub 169 may define a continuation of upper flow bore 117. In some embodiments, dirt valve 119 may include dirt valve opening sleeve 173. Dirt valve opening sleeve 173 may be positioned within dirt valve sleeve 171 and may be slidable relative to dirt valve sleeve 171 from a closed position as depicted in FIG. 3A and an open position as depicted in FIG. 4A. In some embodiments, dirt valve opening sleeve 173 may retard or prevent fluid flow between upper flow bore 117 and central bore 100*a* when in the closed position.

Figure 7:
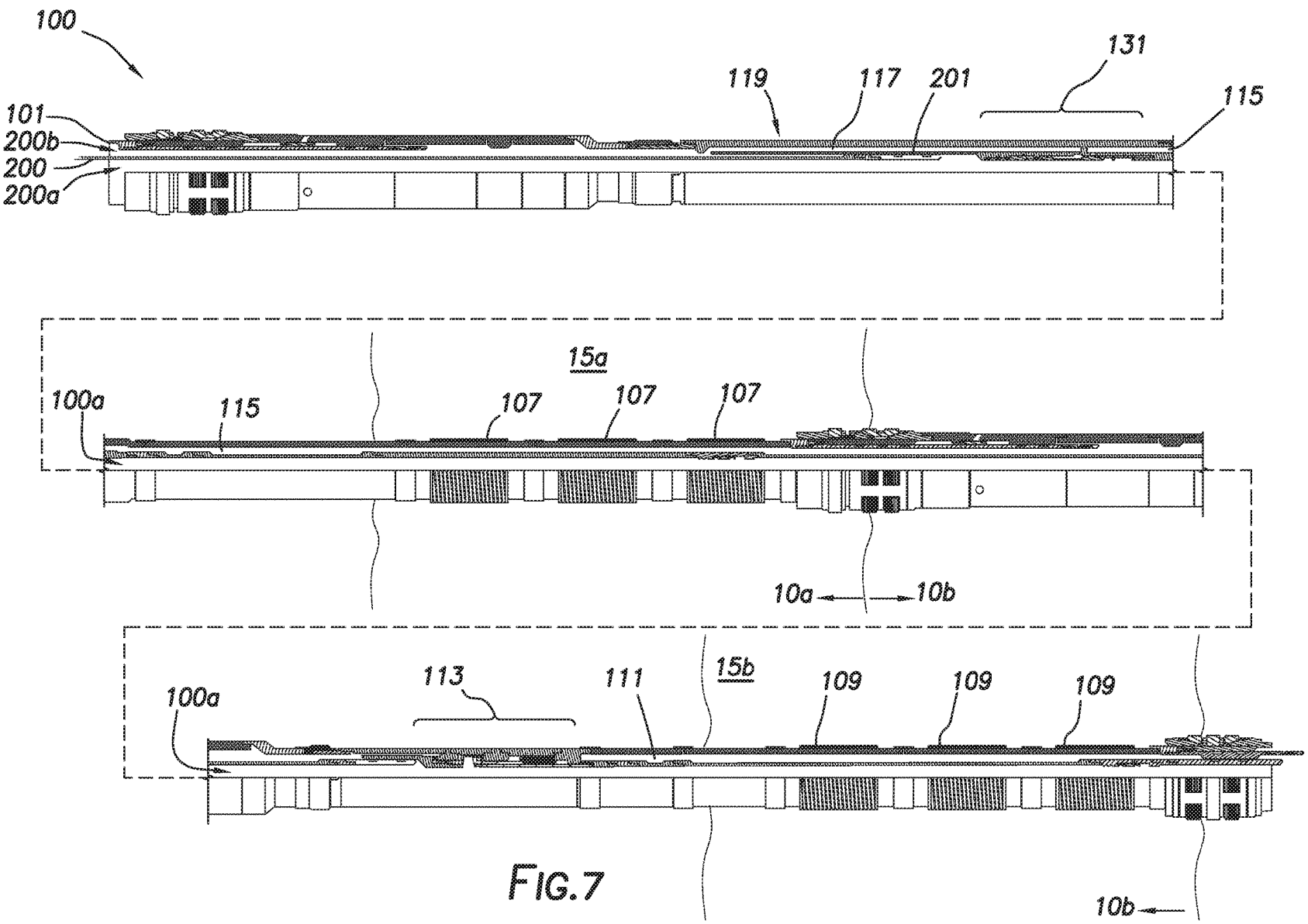
FIG. 7 depicts a partial cross section view of a dual zone completion assembly that includes a concentric flow valve consistent with at least one embodiment of the present disclosure.
Figure 8A:
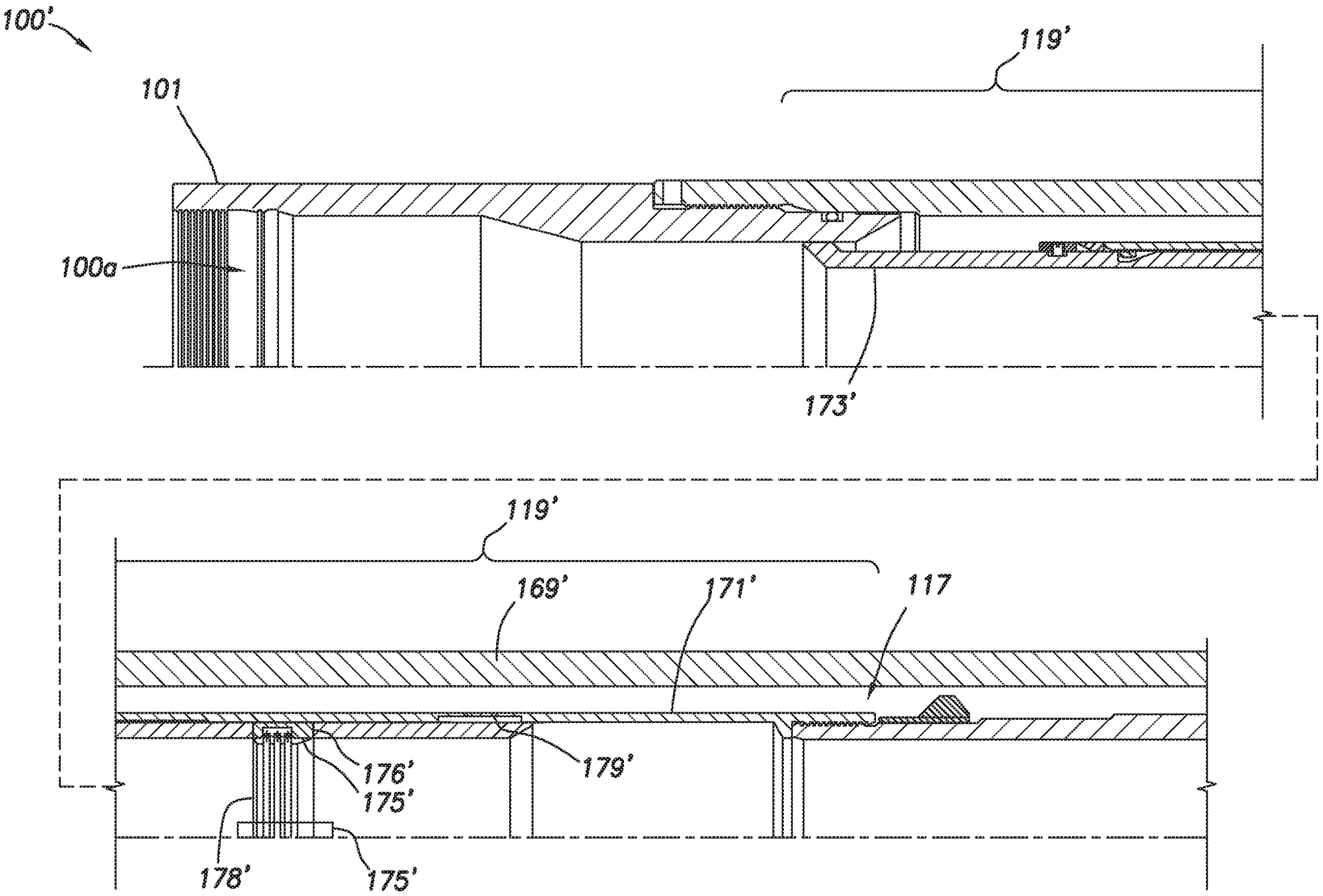
FIGS. 8A-8C depict a cross section view of a concentric flow valve consistent with at least one embodiment of the present disclosure.
Figure 8B:
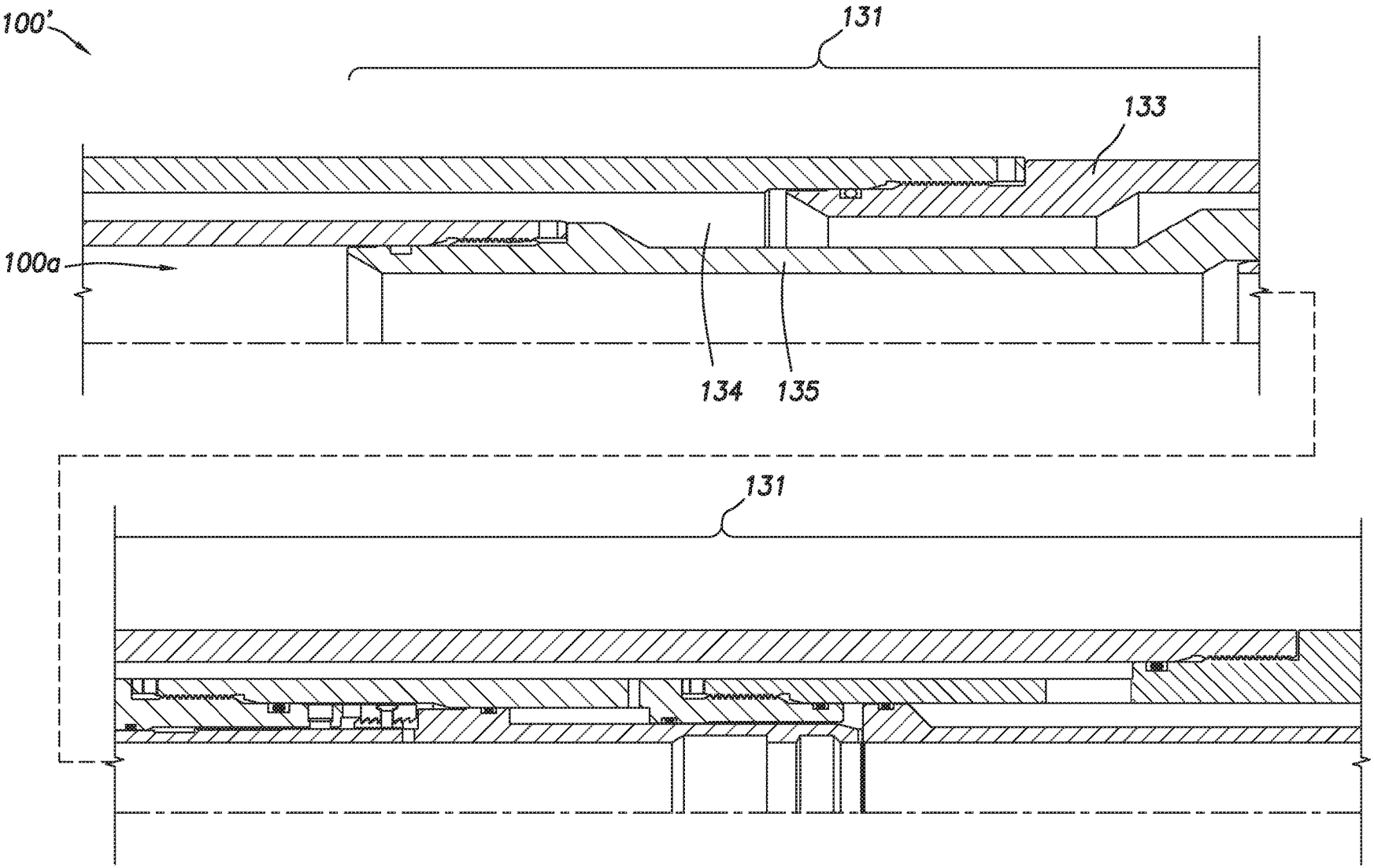
Figure 8C:
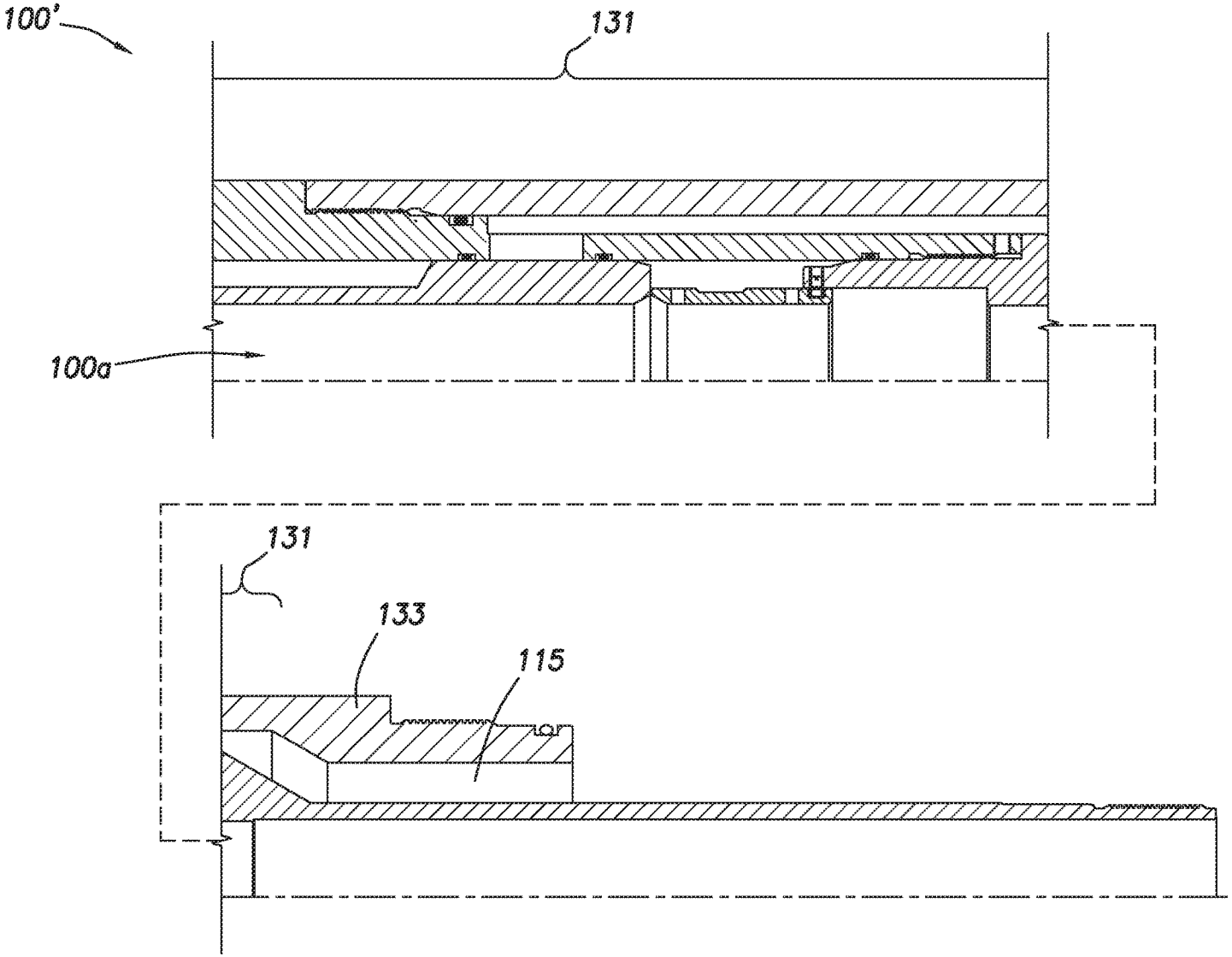

In some embodiments, dirt valve opening sleeve 173 may be transitioned between the closed position and the open position as production tubing string 200 is inserted into dual zone completion assembly 100 as depicted in FIG. 7. As production tubing string 200 passes dirt valve opening sleeve 173, seal assembly 201 may engage interior surface of dirt valve sleeve 171. In some embodiments, seal assembly 201 or another portion of production tubing string 200 such as a mule shoe may engage with shifting profile 175 formed on an inner surface of dirt valve opening sleeve 173. In some embodiments, dirt valve opening sleeve 173 may include one or more protrusions 177 adapted to enter locking groove 179 formed on an inner surface of dirt valve sleeve 171 when dirt valve opening sleeve 173 is in the open position such that protrusions 177 maintain dirt valve opening sleeve 173 in the open position. In some embodiments, each protrusion 177 may be formed as part of locking spring 181 of dirt valve opening sleeve 173. In some embodiments, locking spring 181 may be formed by cutting longitudinal slots 183 in dirt valve opening sleeve 173 aligned with and extending beyond protrusions 177, such that insertion of dirt valve opening sleeve 173 into dirt valve sleeve 171 causes inward radial compression of locking springs 181. The spring tension caused thereby may urge protrusions 177 into locking groove 179 of dirt valve sleeve 171. In some embodiments, seal assembly 201 of production tubing string 200 may engage and seal against an inner surface of seal bore 134.

In some embodiments, as depicted in FIG. 7, once dual zone completion assembly 100 is positioned in wellbore 10, CFV 131 and lower production valve 113 may be opened as discussed above. In some embodiments, lower production valve 113 may be in fluid communication with the bore 200*a* of tubing string 200 via central bore 100*a* to receive fluid from lower zone 10*b*. Annulus 200*b* between tubing string 200 and outer housing 101 may be in fluid communication with upper producing formation 15*a* through CFV 131. Fluid from upper producing formation 15*a* may therefore be produced from upper zone 10*a*, traveling through upper zone screens, lower flow bore 115, CFV 131, upper flow bore 117, dirt valve 119, and into annulus 200*b*. In some embodiments, a control valve assembly may be used to select whether upper zone 10*a* or lower zone 10*b* is produced by, for example and without limitation, opening fluid flow to the surface from annulus 200*b* or bore 200*a* of tubing string 200.

In some embodiments, dual zone completion assembly 100 may include other arrangements of components as discussed herein above. For example, as depicted in FIGS. 8A-8C and 9A-9D, dual zone completion assembly 100' may include dirt valve 119'. In some embodiments, dirt valve 119' may, for example and without limitation, prevent solids from accumulating in upper flow bore 117 during running and gravel packing operations. In some embodiments, dirt valve 119' may allow fluid leakage between central bore 100*a* and upper flow bore 117.

Figure 9A:
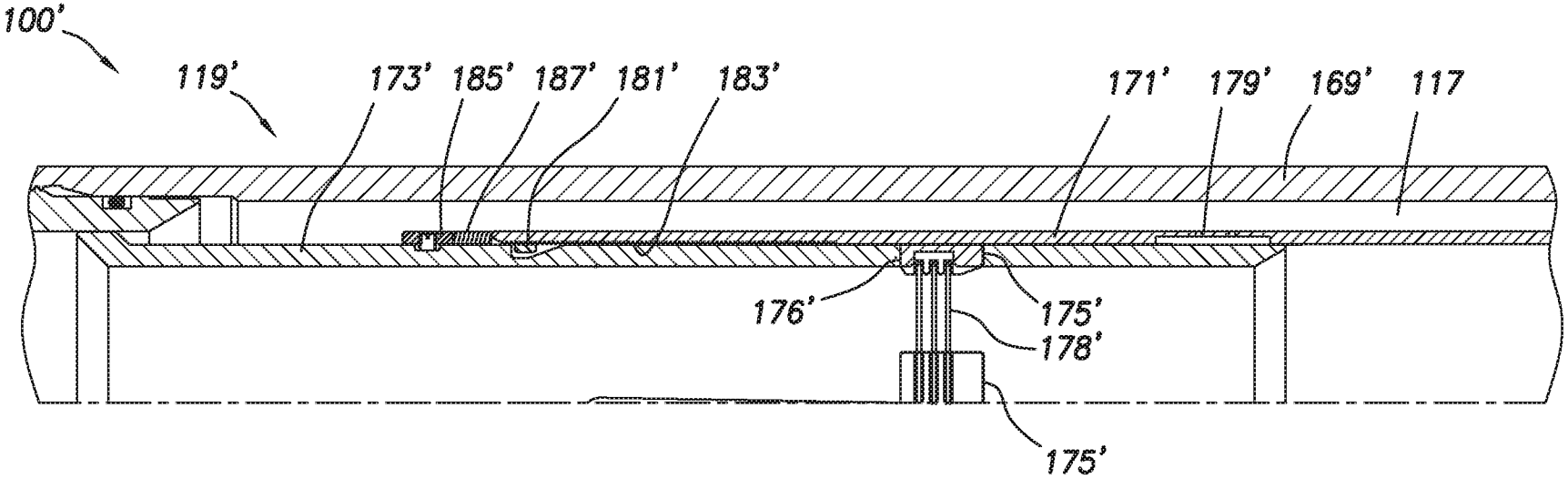
FIGS. 9A-9D depict partial cross section views of the concentric flow valve of FIGS. 8A-8C.

In some embodiments, dirt valve 119' may include dirt valve outer sub 169'. Dirt valve outer sub 169' may be formed as part of outer housing 101. In some embodiments, dirt valve outer sub 169' may be mechanically coupled to outer sub 133 of CFV 131. In some embodiments, dirt valve 119' may include dirt valve sleeve 171' positioned within dirt valve outer sub 169'. In some embodiments, dirt valve sleeve 171' may mechanically couple to seal bore 134. In some embodiments, dirt valve sleeve 171' and dirt valve outer sub 169' may define a continuation of upper flow bore 117. In some embodiments, dirt valve 119' may include dirt valve opening sleeve 173'. Dirt valve opening sleeve 173' may be positioned within dirt valve sleeve 171' and may be slidable relative to dirt valve sleeve 171' from a closed position as depicted in FIG. 9A and an open position as depicted in FIG. 9C. In some embodiments, dirt valve opening sleeve 173' may retard or prevent fluid flow between upper flow bore 117 and central bore 100*a* when in the closed position.

In some embodiments, dirt valve 119' may include one or more dirt valve dogs 175'. Dirt valve dogs 175' may be positioned in dirt valve opening sleeve 173' such that each dirt valve dog 175' extends through an aperture 176' formed in dirt valve opening sleeve 173'. In some embodiments, biasing element 178' may be positioned to bias dirt valve dogs 175' radially outward through apertures 176' of dirt valve opening sleeve 173' and into contact with the inner surface of dirt valve sleeve 171'. In some embodiments, biasing element 178' may be one or more wire ring springs as depicted in FIG. 9D positioned to press radially outward against dirt valve dogs 175'. In some embodiments, dirt valve dogs 175' may extend at least partially into the interior of dirt valve opening sleeve 173'.

Figure 9B:
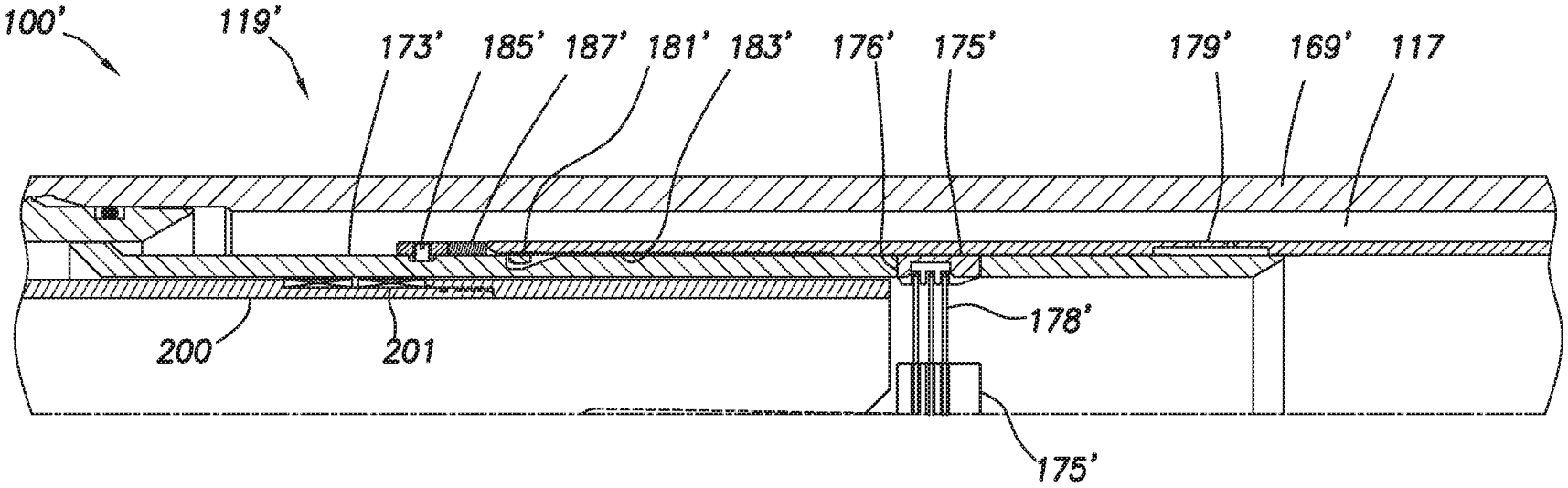
Figure 9C:
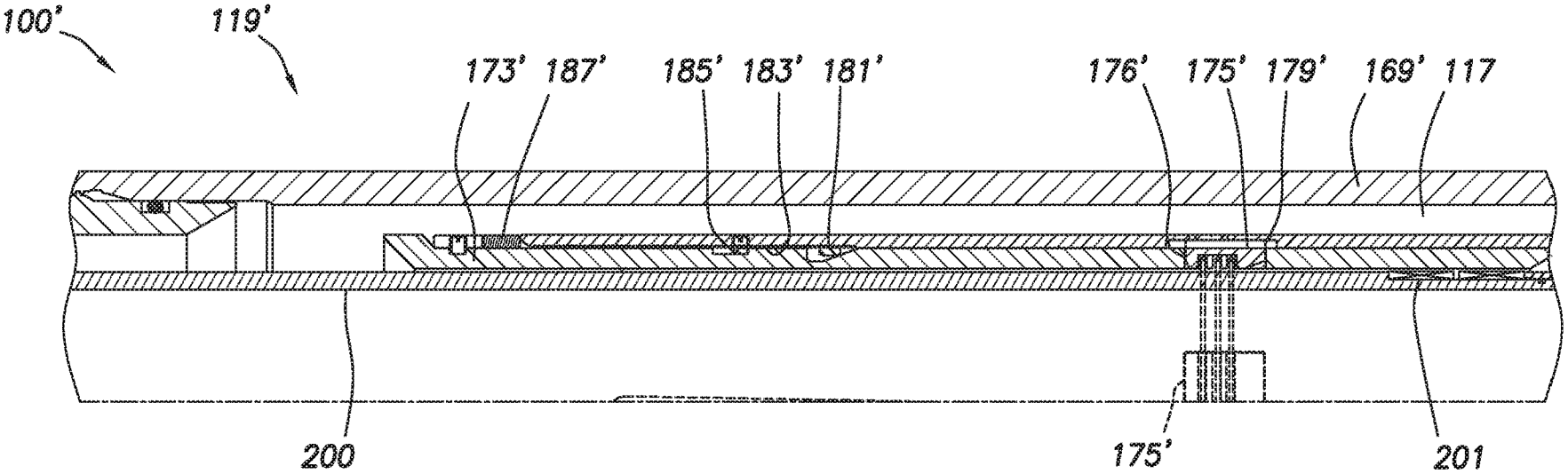
Figure 9D:
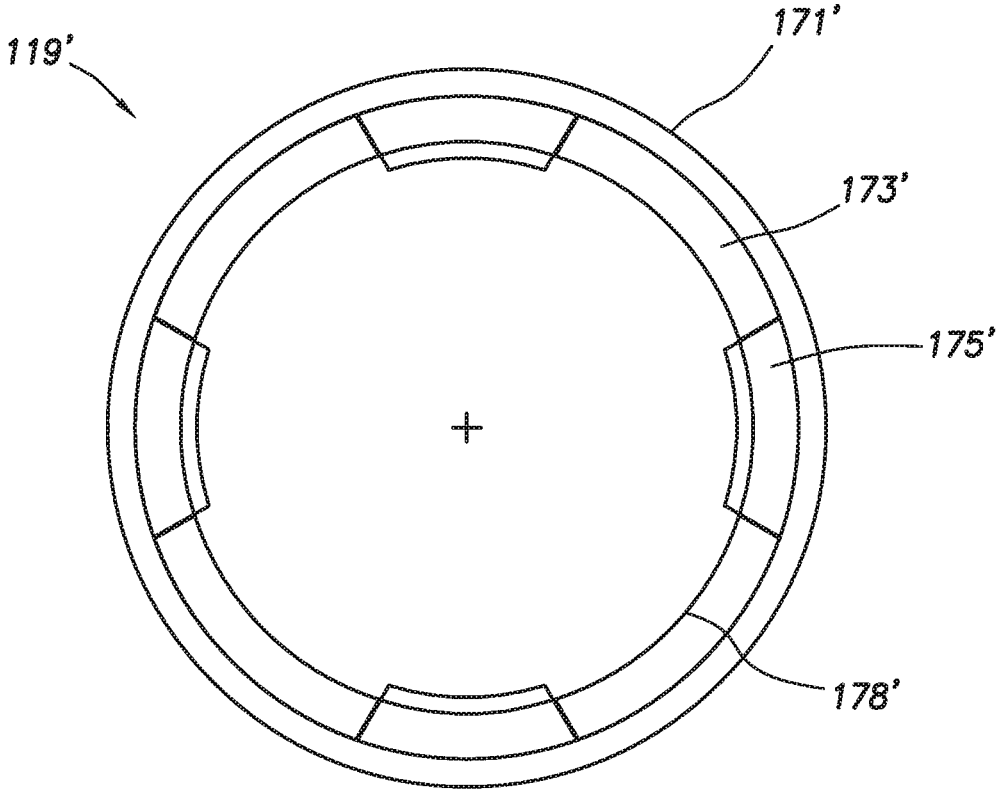

In some embodiments, dirt valve opening sleeve 173' may be transitioned between the closed position and the open position as production tubing string 200 is inserted into dual zone completion assembly 100' as depicted in FIGS. 9A-9C. As production tubing string 200 passes into dirt valve opening sleeve 173', seal assembly 201 may engage interior surface of dirt valve sleeve 171'. In some embodiments, seal assembly 201 or another portion of production tubing string 200 such as a mule shoe may engage with dirt valve dogs 175'.

In some embodiments, dirt valve sleeve 171' may include locking groove 179' formed on an inner surface of dirt valve sleeve 171'. When dirt valve opening sleeve 173' is in the open position, dirt valve dogs 175' may be radially extended from the outer surface of dirt valve opening sleeve 173' by biasing element 178' such that dirt valve dogs 175' enter locking groove 179' to maintain dirt valve opening sleeve 173' in the open position. In some embodiments, once dirt valve dogs 175' are extended, dirt valve dogs 175' may extend substantially out of the interior of dirt valve opening sleeve 173' such that production tubing string 200 may pass through dirt valve opening sleeve 173' once dirt valve opening sleeve 173' is in the open position. In some embodiments ratchet ring 181' may be positioned in an outer surface of dirt valve opening sleeve 173' and may engage ratchet teeth 183' formed on the interior surface of dirt valve sleeve 171' when dirt valve opening sleeve 173' is in the open position. In some embodiments, ratchet ring 181' may be used to maintain dirt valve opening sleeve 173' in the closed position. In some embodiments, one or more shear elements 185' may be positioned between dirt valve opening sleeve 173' and dirt valve sleeve 171' to maintain dirt valve opening sleeve 173' in the closed position until a sufficient force is exerted by production tubing string 200 to shear the shear element. In some embodiments, dirt valve 119' may include assembly ring 187' used during the assembly of dirt valve 119'.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A concentric flow valve for a downhole tool comprising:

an outer sub, the outer sub being tubular;

an upper seal bore sleeve positioned within the outer sub, the upper seal bore sleeve being tubular, the annular space between the outer sub and the upper seal bore sleeve defining an upper flow bore;

a lower inner sleeve positioned within the outer sub, the lower inner sleeve being tubular, the annular space between the outer sub and the lower inner sleeve defining a lower flow bore;

a ported sub, the ported sub mechanically coupled to the outer sub, the ported sub separating the upper flow bore from the lower flow bore, the ported sub including:

an upper ported sleeve mechanically coupled to the upper seal bore sleeve and, the upper ported sleeve including an upper valve port fluidly coupling the interior and the exterior of the upper ported sleeve; and a lower ported sleeve mechanically coupled to the lower inner sleeve, the lower ported sleeve including a lower valve port fluidly coupling the interior and the exterior of the lower ported sleeve;

an opening sleeve, the opening sleeve being tubular, the opening sleeve positioned within the ported sub, the opening sleeve including an upper flange and a lower flange, the upper flange and lower flange defining a radial depression in the outer surface of the opening sleeve, the radial depression and ported sub defining an inner wall of a valve flow path, the valve flow path fluidly coupled to the upper and lower flow bores when the opening sleeve is in an open position; and a piston, the piston positioned within the upper seal bore sleeve, the piston mechanically coupled to the opening sleeve, the piston and upper seal bore sleeve defining an opening cylinder, the opening cylinder fluidly coupled to the upper flow bore.

2. The concentric flow valve of claim 1, further comprising a shear sleeve, the shear sleeve mechanically coupled to the opening sleeve, the shear sleeve mechanically coupled to the lower inner sleeve by a temporary retainer.

3. The concentric flow valve of claim 1, further comprising a C-clip positioned about the opening piston, the C-clip positioned within a C-clip recess formed in the upper seal bore sleeve.

4. The concentric flow valve of claim 1, further comprising:

one or more piston ratchet teeth formed on an outer surface of the opening piston; and a ratchet pawl, the ratchet pawl positioned about the opening piston, the ratchet pawl positioned within a ratchet recess formed in the upper seal bore sleeve, the ratchet pawl engaging the piston ratchet teeth.

5. The concentric flow valve of claim 1, further comprising a mechanical opening profile formed on an inner surface of the opening piston.

6. The concentric flow valve of claim 1, further comprising a mechanical shifting profile formed on an inner surface of the opening sleeve.

7. The concentric flow valve of claim 1 further comprising:

a dirt valve, the dirt valve including:

a dirt valve outer sub, the dirt valve outer sub coupled to the outer sub;

a dirt valve sleeve positioned within the dirt valve outer sub, the dirt valve sleeve coupled to the upper seal bore sleeve, the dirt valve outer sub and dirt valve sleeve defining a continuation of the upper flow bore; and a dirt valve opening sleeve, the dirt valve opening sleeve positioned within the dirt valve sleeve, the dirt valve opening sleeve slidable relative to the dirt valve sleeve between a closed position and an open position, the dirt valve opening sleeve retarding or preventing fluid flow into the upper flow bore when the dirt valve opening sleeve is positioned in the closed position.

8. The concentric flow valve of claim 7, wherein the dirt valve further comprises one or more dirt valve dogs, each dirt valve dog positioned at least partially within an aperture formed in the dirt valve opening sleeve and in contact with the inner surface of the dirt valve sleeve, each dirt valve dog biased outward into contact with the inner surface of the dirt valve sleeve by one or more wire ring springs.

9. The concentric flow valve of claim 8, wherein the dirt valve sleeve comprises a locking groove formed on an inner surface thereof such that each dirt valve dog enters the locking groove when the dirt valve opening sleeve is in the open position.

10. A method comprising:

providing a concentric flow valve, the concentric flow valve including:

an outer sub, the outer sub being tubular;

an upper seal bore sleeve positioned within the outer sub, the upper seal bore sleeve being tubular, the annular space between the outer sub and the upper seal bore sleeve defining an upper flow bore;

a lower inner sleeve positioned within the outer sub, the lower inner sleeve being tubular, the annular space between the outer sub and the lower inner sleeve defining a lower flow bore;

a ported sub, the ported sub mechanically coupled to the outer sub, the ported sub separating the upper flow bore from the lower flow bore, the ported sub including:

an upper ported sleeve mechanically coupled to the upper seal bore sleeve, the upper ported sleeve including an upper valve port fluidly coupling the interior and the exterior of the upper ported sleeve; and a lower ported sleeve mechanically coupled to the lower inner sleeve, the lower ported sleeve including a lower valve port fluidly coupling the interior and the exterior of the lower ported sleeve;

an opening sleeve, the opening sleeve being tubular, the opening sleeve positioned within the ported sub, the opening sleeve including an upper flange and a lower flange, the upper flange and lower flange defining a radial depression in the outer surface of the opening sleeve, the radial depression and ported sub defining an inner wall of a valve flow path, the valve flow path fluidly decoupled from at least one of the upper and lower flow bores when the opening sleeve is in an open position; and a piston, the piston positioned within the upper seal bore sleeve, the piston mechanically coupled to the opening sleeve, the piston and upper seal bore sleeve defining an opening cylinder, the opening cylinder fluidly coupled to the upper flow bore;

increasing the pressure within an interior of the concentric flow valve;

causing a differential pressure between the interior of the concentric flow valve and the opening cylinder;

shifting the piston into an actuated position; and shifting the opening sleeve into an open position such that the valve flow path is aligned with the upper and lower valve ports.

11. The method of claim 10 wherein the concentric flow valve further comprises a dirt valve, the dirt valve including:

a dirt valve outer sub, the dirt valve outer sub coupled to the outer sub;

a dirt valve sleeve positioned within the dirt valve outer sub, the dirt valve sleeve coupled to the upper seal bore sleeve, the dirt valve outer sub and dirt valve sleeve defining a continuation of the upper flow bore; and a dirt valve opening sleeve, the dirt valve opening sleeve positioned within the dirt valve sleeve, the dirt valve opening sleeve slidable relative to the dirt valve sleeve between a closed position and an open position, the dirt valve opening sleeve retarding or preventing fluid flow into the upper flow bore when the dirt valve opening sleeve is positioned in the closed position;

wherein the method further comprises shifting the dirt valve opening sleeve from the closed position to the open position.

12. The method of claim 11, wherein the dirt valve further comprises one or more dirt valve dogs, each dirt valve dog positioned at least partially within an aperture formed in the dirt valve opening sleeve and in contact with the inner surface of the dirt valve sleeve, each dirt valve dog biased outward into contact with the inner surface of the dirt valve sleeve by one or more wire ring springs.

13. The method of claim 12, wherein the dirt valve sleeve comprises a locking groove formed on an inner surface thereof, wherein shifting the dirt valve opening sleeve comprises:

engaging the one or more dirt valve dogs with a production tubing string;

moving the dirt valve opening sleeve from the closed position to the open position; and biasing each dirt valve dog radially outward into the locking groove when the dirt valve opening sleeve is in the open position.

* * * * *